US010522916B2

(12) United States Patent
Rogers et al.

(10) Patent No.: US 10,522,916 B2
(45) Date of Patent: Dec. 31, 2019

(54) HIGH-GAIN CONFORMAL ANTENNA

(71) Applicant: The Boeing Company, Chicago, IL (US)

(72) Inventors: John E. Rogers, Owens Cross Roads, AL (US); John D. Williams, Decatur, AL (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/883,018

(22) Filed: Jan. 29, 2018

(65) Prior Publication Data

US 2019/0237876 A1 Aug. 1, 2019

(51) Int. Cl.
*H01Q 1/48* (2006.01)
*H01Q 9/04* (2006.01)
*H01Q 13/10* (2006.01)

(52) U.S. Cl.
CPC ..... *H01Q 9/045* (2013.01); *H01Q 1/48* (2013.01); *H01Q 13/10* (2013.01)

(58) Field of Classification Search
CPC ..... H01Q 9/045
USPC ..... 343/771
See application file for complete search history.

(56) References Cited

U.S. PATENT DOCUMENTS

| | | | | |
|---|---|---|---|---|
| 6,593,887 | B2 | 7/2003 | Luk et al. | |
| 7,471,248 | B2 | 12/2008 | Popugaev et al. | |
| 9,496,613 | B2 * | 11/2016 | Sawa | H01Q 9/0414 |
| 2003/0103006 | A1 * | 6/2003 | Yamada | H01L 23/66 343/700 MS |
| 2010/0245155 | A1 * | 9/2010 | Miyazato | G01S 7/032 342/104 |

* cited by examiner

*Primary Examiner* — Peguy Jean Pierre
(74) *Attorney, Agent, or Firm* — Moore Intellectual Property Law, PLLC

(57) ABSTRACT

A high-gain conformal antenna ("HGCA") is disclosed. The HGCA includes a plurality of dielectric layers forming a dielectric structure. The plurality of dielectric layers includes a top dielectric layer that includes a top surface. The HGCA further includes an inner conductor, a cavity, a patch antenna element ("PAE"), and an antenna slot. The inner conductor and cavity are formed within the dielectric structure, the PAE is formed on the top surface of the top dielectric layer above the cavity, and the antenna slot is formed within the PAE. The HGCA is configured to support a transverse electromagnetic ("TEM") signal within the dielectric structure.

21 Claims, 24 Drawing Sheets

HIGH-GAIN CONFORMAL ANTENNA

BACKGROUND

1. Field

The present disclosure is related to antennas, and more specifically, to patch antennas.

2. Related Art

At present, there is a need for antennas that can conform to non-planar, curved surfaces such as aircraft fuselages and wings, ships, land vehicles, buildings, or cellular base stations. Furthermore, conformal antennas reduce radar cross section, aerodynamic drag, are low-profile, and have minimal visual intrusion.

Existing phased array antennas generally include a plurality of antenna elements such as, for example, dipole or patch antennas integrated with electronics that may control the phase and/or magnitude of each antenna element. These phased array antennas are typically complex, expensive, and may be integrated into the surface of an object to which they are designed to operate on. Furthermore, existing phased arrays are generally susceptible to the electromagnetic effects caused by the surfaces on which they are placed, especially if the surfaces are composed of metal (e.g., aluminum, steel, titanium, etc.) or carbon fiber, which is electrically conductive by nature. As such, to compensate for these effects the phased arrays need to be designed taking into account the shape and material of a surface on which they will be placed and, as such, are not flexible for use across multiple types of surfaces, platforms, or uses.

Existing antennas typically have a trade-off between the thickness of the antenna and the bandwidth. A thin antenna, for example, is more flexible, but has a narrower bandwidth. Moreover, existing antennas based on patch antenna elements have a gain-bandwidth product ("GBWP") that is related to the thickness of the antenna such that antennas with low thickness (for conformal applications) have low GBWP. As such, there is a need for a new conformal antenna that addresses these issues.

SUMMARY

Disclosed is a high-gain conformal antenna ("HGCA"). The HGCA includes a plurality of dielectric layers forming a dielectric structure. The plurality of dielectric layers includes a top dielectric layer that includes a top surface. The HGCA further includes an inner conductor, a cavity, a patch antenna element ("PAE"), and an antenna slot. The inner conductor and cavity are formed within the dielectric structure, the PAE is formed on the top surface of the top dielectric layer above the cavity, and the antenna slot is formed within the PAE. The HGCA is configured to support a transverse electromagnetic ("TEM") signal within the dielectric structure.

Also disclosed is a method for fabricating the HGCA utilizing a lamination process. A method includes patterning a first conductive layer on a bottom surface of a first dielectric layer having a top surface and the bottom surface to produce a ground plane, patterning a second conductive layer on a top surface of a second dielectric layer having the top surface and a bottom surface to produce an inner conductor, and laminating the bottom surface of the second dielectric layer to the top surface of the first dielectric layer. The method also includes patterning a third dielectric layer having at least two portions of the third dielectric layer, wherein the third dielectric layer includes a top surface and a bottom surface and patterning a third conductive layer on a top surface of a fourth dielectric layer having a top surface and a bottom surface to produce the PAE with the antenna slot. The method furthermore includes laminating the bottom surface of the fourth dielectric layer to the top surface of the third dielectric layer and laminating the bottom surface of the third dielectric layer to the top surface of the second dielectric layer to produce a composite laminated structure.

Further disclosed is a method for fabricating the HGCA utilizing a three-dimensional ("3-D") additive printing process. The method includes: printing a first conductive layer having a top surface and a first width, wherein the first width has a first center; printing a first dielectric layer on the top surface of the first conductive layer, wherein the first dielectric layer has a top surface; and printing a second dielectric layer on the top surface of the first dielectric layer, wherein the second dielectric layer has a top surface. The method further includes: printing a second conductive layer on the top surface of the second dielectric layer, wherein the second conductive layer has a top surface and a second width, and wherein the second width is less than the first width; printing a third dielectric layer on the top surface of the second conductive layer and on the top surface on the second dielectric layer, wherein the third dielectric layer has a top surface and wherein the third dielectric layer includes at least one cavity within the third dielectric layer; and printing a fourth dielectric layer on the top surface of the third dielectric layer, wherein the fourth dielectric layer has a top surface. Moreover, the method includes printing a third conductive layer on the top surface of the fourth dielectric layer to produce a patch antenna element ("PAE"), wherein the third conductive layer has a top surface and a third width, wherein the third width is less than the first width, wherein the third width is greater than the second width, and wherein the third conductive layer includes an antenna slot within the third conductive layer that exposes the top surface of the fourth dielectric layer through the third conductive layer.

Other devices, apparatus, systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
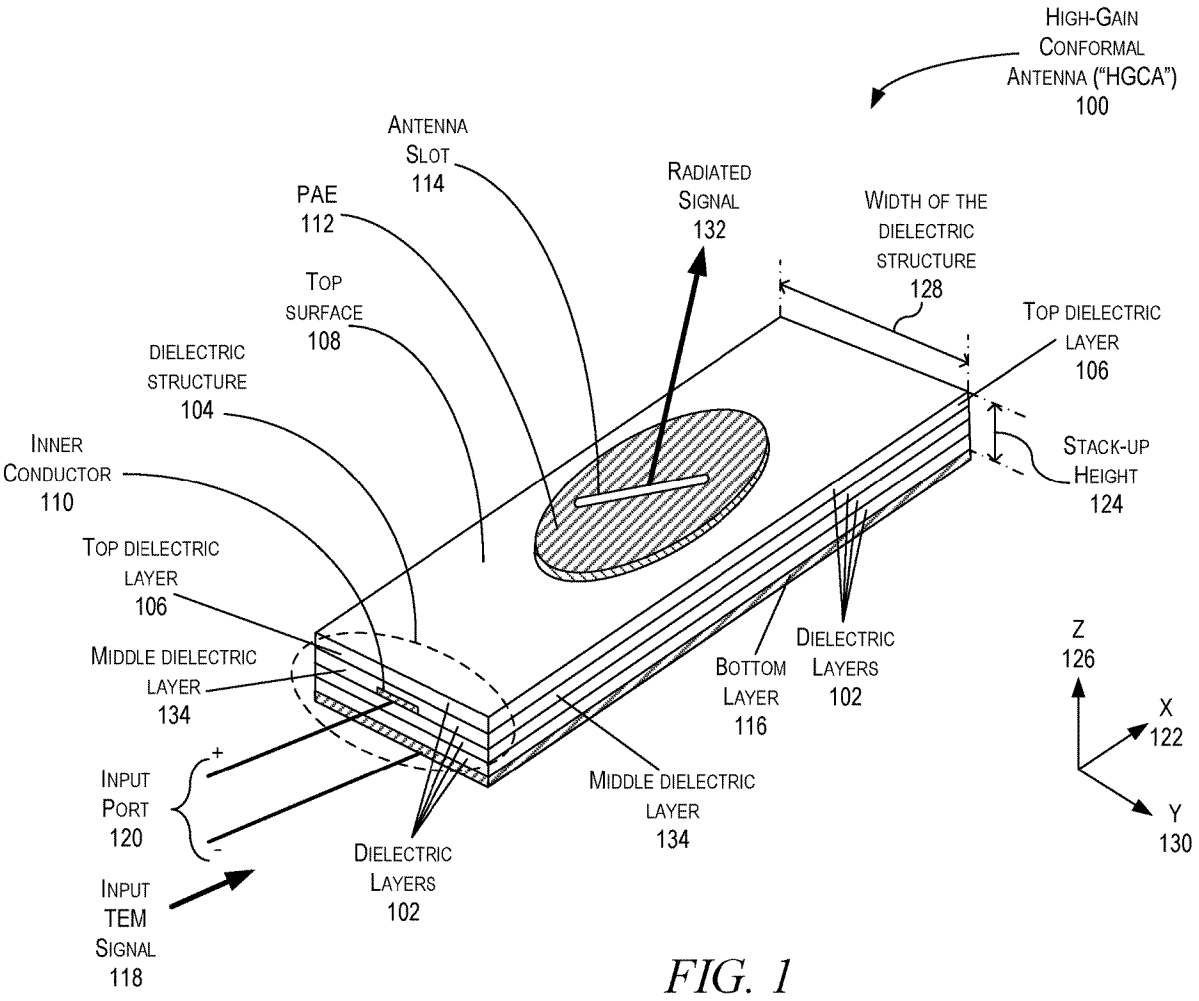
FIG. 1 is a perspective view of an example of an implementation of a high-gain conformal antenna ("HGCA") in accordance with the present disclosure.

A high-gain conformal antenna ("HGCA") is disclosed. The HGCA includes a plurality of dielectric layers forming a dielectric structure. The plurality of dielectric layers includes a top dielectric layer that includes a top surface. The HGCA further includes an inner conductor, a cavity, a patch antenna element ("PAE"), and an antenna slot. The inner conductor and cavity are formed within the dielectric structure, the PAE is formed on the top surface of the top dielectric layer above the cavity, and the antenna slot is formed within the PAE. The HGCA is configured to support a transverse electromagnetic ("TEM") signal within the dielectric structure. The HGCA also includes a bottom conductive layer located below the dielectric structure.

Also disclosed is a method for fabricating the HGCA utilizing a lamination process. A method includes patterning a first conductive layer on a bottom surface of a first dielectric layer having a top surface and the bottom surface to produce a ground plane, patterning a second conductive layer on a top surface of a second dielectric layer having the top surface and a bottom surface to produce an inner conductor, and laminating the bottom surface of the second dielectric layer to the top surface of the first dielectric layer. The method also includes patterning a third dielectric layer having at least two portions of the third dielectric layer, wherein the third dielectric layer includes a top surface and a bottom surface and patterning a third conductive layer on a top surface of a fourth dielectric layer having a top surface and a bottom surface to produce the PAE with the antenna slot. The method furthermore includes laminating the bottom surface of the fourth dielectric layer to the top surface of the third dielectric layer and laminating the bottom surface of the third dielectric layer to the top surface of the second dielectric layer to produce a composite laminated structure.

Further disclosed is a method for fabricating the HGCA utilizing a three-dimensional ("3-D") additive printing process. The method includes: printing a first conductive layer having a top surface and a first width, wherein the first width has a first center; printing a first dielectric layer on the top surface of the first conductive layer, wherein the first dielectric layer has a top surface; and printing a second dielectric layer on the top surface of the first dielectric layer, wherein the second dielectric layer has a top surface. The method further includes: printing a second conductive layer on the top surface of the second dielectric layer, wherein the second conductive layer has a top surface and a second width, and wherein the second width is less than the first width; printing a third dielectric layer on the top surface of the second conductive layer and on the top surface on the second dielectric layer, wherein the third dielectric layer has a top surface and wherein the third dielectric layer includes at least one cavity within the third dielectric layer; and printing a fourth dielectric layer on the top surface of the third dielectric layer, wherein the fourth dielectric layer has a top surface. Moreover, the method includes printing a third conductive layer on the top surface of the fourth dielectric layer to produce a patch antenna element ("PAE"), wherein the third conductive layer has a top surface and a third width, wherein the third width is less than the first width, wherein the third width is greater than the second width, and wherein the third conductive layer includes an antenna slot within the third conductive layer that exposes the top surface of the fourth dielectric layer through the third conductive layer.

More specifically, in FIG. 1, a perspective view of an example implementation of the HGCA 100 is shown in accordance with the present disclosure. The HGCA 100 includes a plurality of dielectric layers 102 forming a dielectric structure 104. The plurality of dielectric layers 102 includes a top dielectric layer 106 that includes a top surface 108. The HGCA 100 further includes an inner conductor 110, at least one cavity (not shown) within the dielectric structure 104, a PAE 112, and an antenna slot 114. The inner conductor 110 is formed within the dielectric structure 104, the PAE 112 is formed on the top surface 108 of the top dielectric layer 106, and the antenna slot 114 is formed within the PAE 112. Moreover, the HGCA 100 also includes a bottom layer 116 that is a conductor and is located below the dielectric structure 104. In this example, the top surface 108 of the top dielectric layer 106 is also the top surface of the dielectric structure 104. Moreover, the PAE 112 is also a conductor. The antenna slot 114 is formed or cut along the PAE 112 and is angled with respect to the inner conductor 110. The antenna slot 114 allows the top surface 108 to be exposed through the PAE 112. The HGCA 100 is configured to radiate a TEM input signal 118 that is inserted into an input port 120 of the HGCA 100 in a direction along an X-axis 122. In this example, the input port 120 is shown in signal communication with both the inner conductor 110 and the bottom layer 116, where the inner conductor 110 has a first polarity (e.g., positive), with respect to the bottom layer 116, that has an opposite polarity (e.g., negative). However, it is appreciated by those of ordinary skill in the art that the polarities alternate in time for electromagnetic signals. In this example, the inner conductor 110, PAE 112, and bottom layer 116 may be metal conductors. The bottom layer 116, for example, may be constructed of electroplated copper, while the inner conductor 110 and PAE 112 may be constructed of printed silver ink.

It is appreciated by those of ordinary skill in the art that the circuits, components, modules, and/or devices of, or associated with, the HGCA 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

In this example, each dielectric layer, of the plurality of dielectric layers 102, may be an RF dielectric material (such as, for example, a dielectric laminate material) and the inner conductor 110 may be a RF microstrip or stripline conductor. The inner conductor 110 may be located at a predetermined center position within the dielectric structure 104. In this example, the center position is equal to approximately half of a stack-up height 124 along a Z-axis 126 and approximately half of a width 128 of the dielectric structure 104 along a Y-axis 130. As an example, the dielectric laminate material may be constructed of PYRALUX® flexible circuit materials produced by E. I. du Pont de Nemours and Company of Wilmington, Del.

Alternatively, the dielectric structure 104 may be constructed utilizing a three-dimensional ("3-D") additive printing process. In this example, each dielectric layer (of the dielectric structure 104) may be constructed by printing (or "patterning"), which includes successively printing dielectric layers with dielectric ink and printing conductive layers with conductive ink. In these examples, each dielectric layer (of the dielectric structure 104) may have a thickness that is approximately equal 10 mils. The bottom layer 116, inner conductor 110, and PAE 112 may have a thickness that is, for example, approximately equal to 0.7 mils (i.e., about 18 micrometers). For purposes of illustration, in this example, dielectric structure 104 may include four (4) dielectric layers 102 and three (3) 2 mils of adhesive layers (not shown) between the four dielectric layers 102; however, this may vary based on the design of the HGCA 100.

In this example, the input TEM signal 118 propagates along the length of the HGCA 100 (along the X-axis 122) towards the PAE 112 with the angled antenna slot 114 where electromagnetic coupling occurs between the inner conductor 110 and PAE 112 with the antenna slot 114 to produce a radiated signal 132 that is emitted from the PAE 112 with the angled antenna slot 114. It is appreciated by those of ordinary skill in the art that the electromagnetic characteristics of the radiated signal 132 are determined by the geometry (or shape), dimensions (e.g., radius, thickness), and position of the PAE 112 along the top surface 108 and the geometry and dimensions of the antenna slot 114 within the PAE 112. In this example, the inner conductor 110 is shown to be located within a middle dielectric layer 134.

Figure 2:
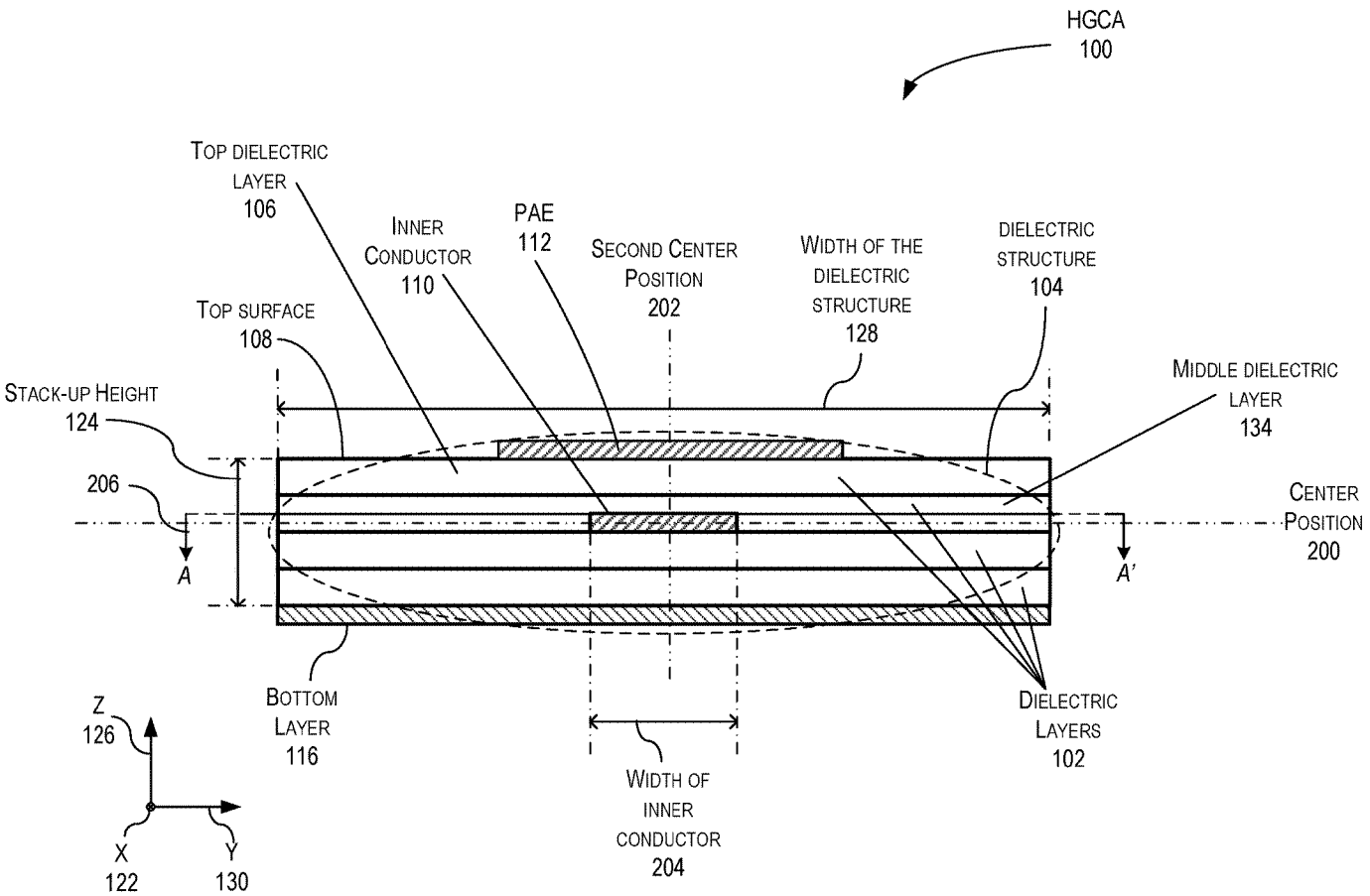
FIG. 2 is a cross-sectional view of the HGCA (shown in FIG. 1) showing in the inner conductor in accordance with the present disclosure.

In FIG. 2, a cross-sectional view of the HGCA 100 is shown in accordance with the present disclosure. In this view, the plurality of dielectric layers 102, top dielectric layer 106, dielectric structure 104, inner conductor 110, top surface 108, bottom layer 116, and the PAE 112 are shown. In this view, the at least one cavity is not shown since it is being blocked by the middle dielectric layer 134. In this example, each of the dielectric layers of the plurality of dielectric layers 102 are RF dielectrics.

The center position 200 that may be equal to approximately half of the stack-up height 124 and the second center position 202 that is equal to approximately half of the width 128 of the dielectric structure 104 are also shown. It is appreciated by those of ordinary skill in the art that while only four (4) dielectric layers are shown in the plurality of dielectric layers 102, any number greater than two (2) may be utilized for the number of dielectric layers of the plurality of dielectric layers 102. The inner conductor 110 is also shown to have a width 204 that is approximately centered about the second center position 202. In this example, the inner conductor 110 is an RF microstrip or stripline located below the PAE 112 with the antenna slot 114 acting as an aperture coupled antenna feed configured to couple energy from the input TEM signal 118 to the PAE 112. In general, the width 204 of the inner conductor 110 and the position below (i.e., the center position 200) the PAE 112 are predetermined by the design of the HGCA 100 to approximately match the impedance between the inner conductor 110 and the PAE 112 with the antenna slot 114. As such, while the center position 200 is shown in FIG. 2 to be approximately in the center of the stack-up height 124, it is appreciated by those of ordinary skill in the art that this is an approximation that may vary because the actual center position 200 may be predetermined from the design of the HGCA 100. However, for purposes of illustration, the predetermined position is assumed to be generally close to the center position of the stack-up height, but it is appreciated that this may vary based on the actual design of the HGCA 100. Additionally, while not shown in this view, the antenna slot 114 within the PAE 112 increases the bandwidth of the PAE 112 and also has a predetermined angle along the PAE 112 with respect to the inner conductor 110 to provide circular polarization from the PAE 112 and a predetermined slot width to match the impedance between the inner conductor 110 and the PAE 112. In this example, a cutting plane A-A' 206 is shown looking into the HGCA 100. In this view, the antenna slot 114 is not visible because it is located within the PAE 112 that is therefore blocked by other parts of the PAE 112 shown in this view.

In an example of operation, the input TEM signal 118 travels in the X-axis 122 from the input port 120 to the PAE 112 between the inner conductor 110 and bottom layer 116. The electromagnetic field at the end of the inner conductor 110 couples to the PAE 112 with the antenna slot 114. The PAE 112 with the antenna slot 114 then radiates the signal 132 through free-space.

Figure 3:
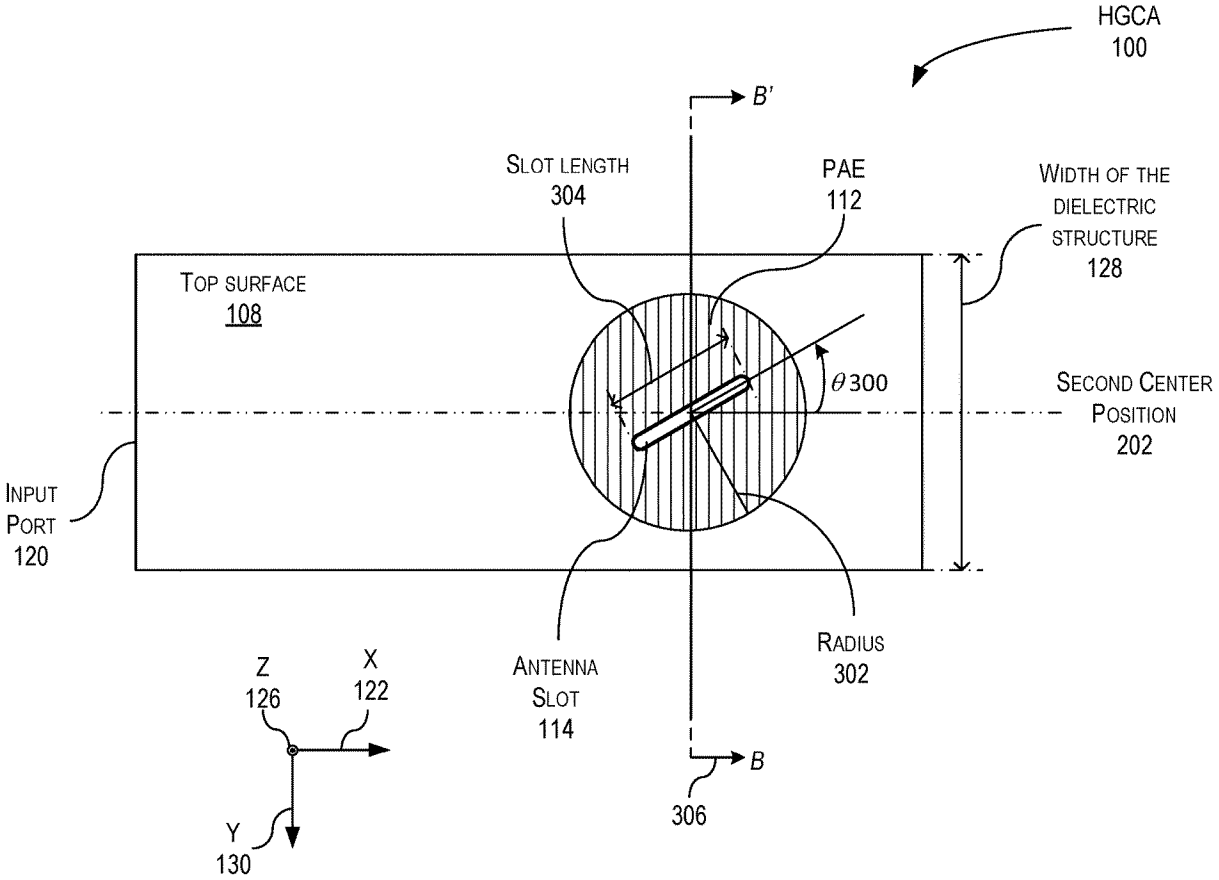
FIG. 3 is a top view of the HGCA (shown in FIGS. 1 and 2) in accordance with the present disclosure.

In FIG. 3, a top view of the HGCA 100 (shown in FIGS. 1 and 2) is shown in accordance with the present disclosure. In this example, the antenna slot 114 is shown within the PAE 112 at an angle θ 300 with respect to the inner conductor 110 along the second center position 202. In this example, the antenna slot 114 is shown to be centered about the second center position 202. The angle θ 300 may be negative or positive. In this example, the PAE 112 is shown to have a circular shape with a radius 302. As discussed earlier, the geometry (or shape), dimensions (e.g., radius, thickness), and position of the PAE 112 along the top surface 108 and the geometry and dimensions of the antenna slot 114 within the PAE 112 determine the electromagnetic characteristics of the radiated signal 132. Moreover, in this example, the PAE 112 is circular with a radius 302 and the antenna slot 114 has a slot length 304. In general, the radius 302 of the PAE 112 and the slot length 304 are predetermined to optimize/maximize the radiated signal 132 produced by the PAE 112 with the antenna slot 114 at a predetermined operating frequency. It is appreciated by those of ordinary skill in the art that other geometries may also be utilized in the present disclosure without departing from the spirit or principles disclosed herein. In this example, a cutting plane B-B' 306 along the Y-axis 130 is shown looking into the HGCA 100 along the X-axis 122. In this view, the at least one cavity is not visible because it is located below the PAE 112 and is therefore blocked by the PAE 112 shown in this view.

Figure 4:
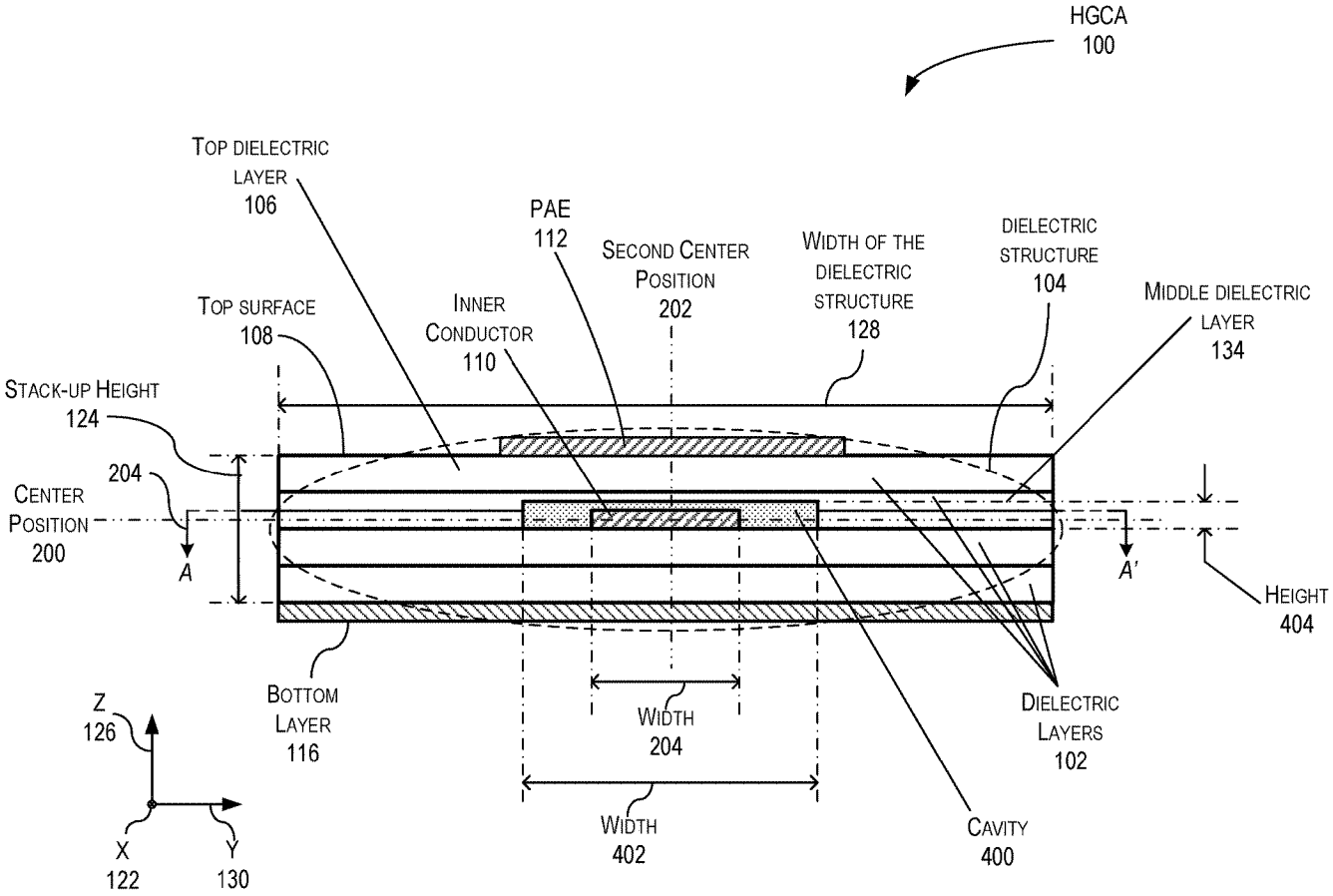
FIG. 4 is a cross-sectional view of the HGCA showing a patch antenna element ("PAE") in an example implementation of a single cavity in accordance with the present disclosure.

In FIG. 4, a cut-away view (along cutting plane BB' 306 shown in FIG. 3) of the HGCA 100 of an example of an implementation of a cavity 400 is shown in accordance with the present disclosure. In this example, the HGCA 100 includes the single cavity 400 within the middle dielectric layer 134. The cavity 400 has a width 402 that is greater than the width 204 of the inner conductor 110 and a height 404 that is greater than a height of the inner conductor 110. In this example, cavity 400 may have a circular perimeter such that the width 402 of the cavity may be approximately equal to the width of the PAE 112, which is equal to twice the radius 302 (i.e., the diameter of the cavity may be approximately equal to the diameter of the PAE 112). Alternatively, the diameter of the cavity may be more or less than the diameter of the PAE 112. In general, the width 402 of the cavity 400 is a predetermined value that is based on the design of the HGCA 100 such as to optimize the gain and bandwidth of the PAE 112 with the antenna slot 114. In this example, the cavity 400 may be an air-filled cavity 400.

Figure 5:
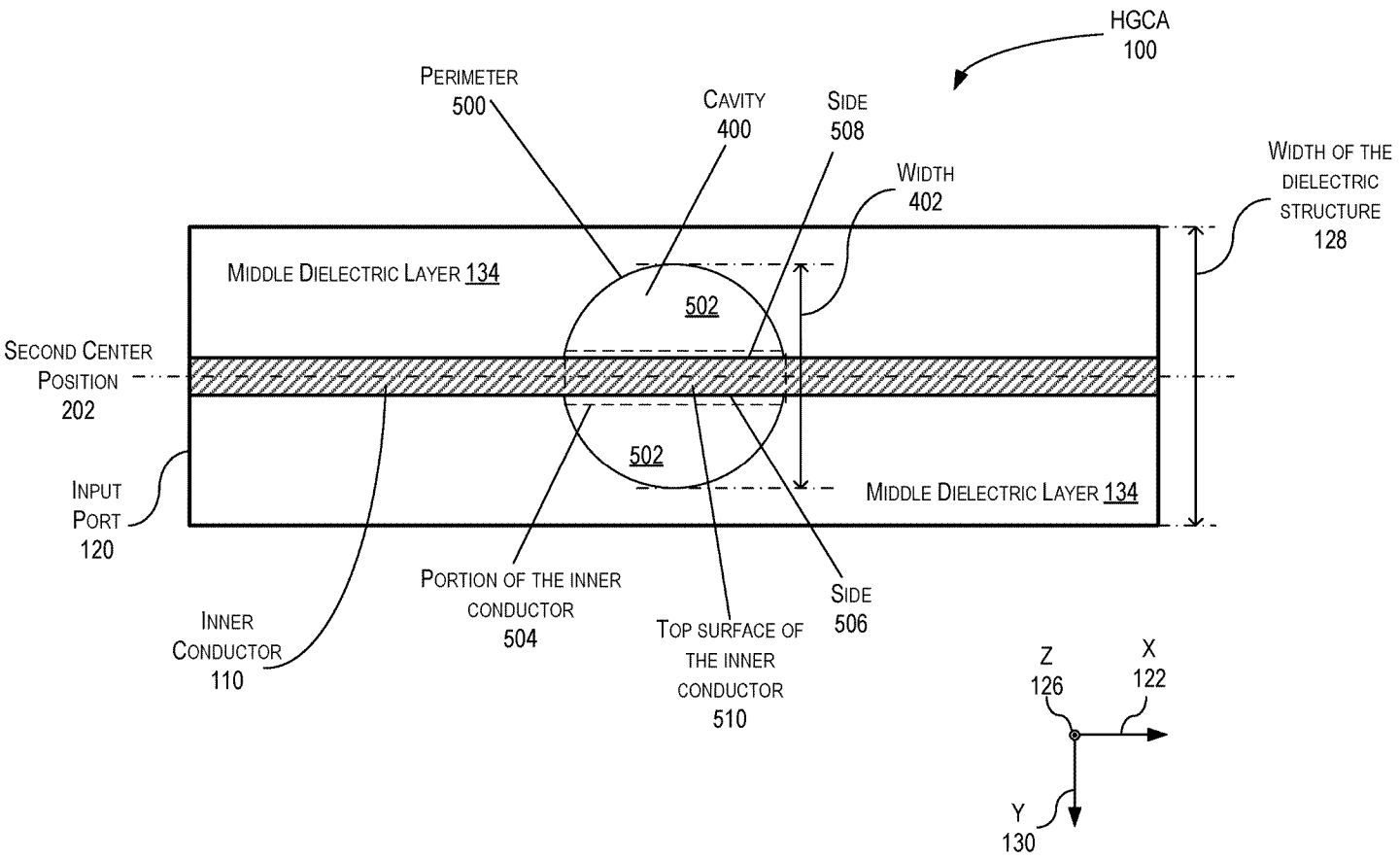
FIG. 5 is a top cut-away view (along a cutting plane AA') of the HGCA showing an example of an implementation of a single cavity in accordance with the present disclosure.

FIG. 5 is a top cut-away view (along cutting plane AA' 206 shown in FIG. 2) showing the inner conductor 110 running along the HGCA 100 length (in the direction of the X-axis 122) in an example of an implementation of the single cavity 400 in accordance with the present disclosure. In this example, the inner conductor 110 is shown to be in the middle dielectric layer 134 of the laminated dielectric structure 104 between two other dielectric layers (not shown). The cavity 400 is also shown within the middle dielectric layer 134. The cavity 400 has a perimeter 500 that is circular with a diameter equal to the width 402 of the cavity 400. In this example, the cavity 400 is shown to cut through the middle dielectric layer 134 exposing a top surface 502 of the dielectric layer below the middle dielectric layer 134. As in the example shown in FIG. 4, the cavity 400 is located below the PAE 112 and the width 402 of the cavity 400 where the width 402 is approximately equal to twice the radius 302. The cavity 400 is air filled and has the width 402 and the height 404 occupying the space above the top surface 502 of the dielectric layer and the top surface of the inner conductor 510.

Figure 6:
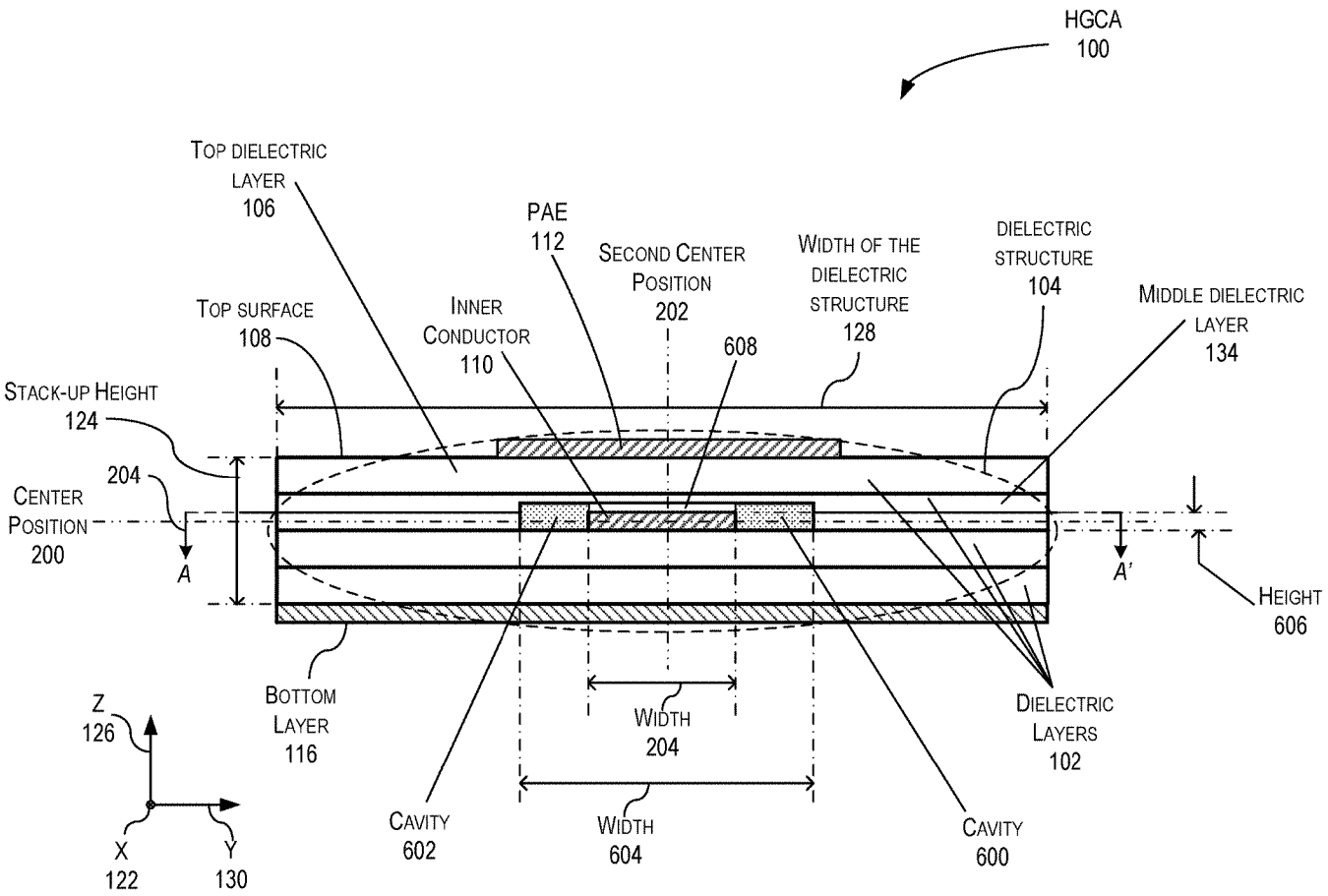
FIG. 6 is a cut-away view (along cutting plane BB') of the HGCA of an example of an implementation of the PAE and two cavities in accordance with the present disclosure.

In FIG. 6, a cut-away view (along cutting plane BB' 306) of the HGCA 100 of an example of an implementation of two cavities 600 and 602 is shown in accordance with the present disclosure. In this example, the HGCA 100 includes the two cavities 600 and 602 within the middle dielectric layer 134. The cavities 600 and 602 have a combined width 604 that is greater than the width 204 of the inner conductor 110 and a height 606 that is approximately equal to or greater than a height of the inner conductor 110. In this example, the first cavity 600 may have less than half of a circular perimeter and the second cavity 602 may also have less than half of a circular perimeter such that the combined width 604 of the cavities 600 and 602 may be approximately equal to the width of the PAE 112, which is equal to twice the radius 302. Again, in general, the combined width 604 of the cavities 600 and 602 is a predetermined value that is based on the design of the HGCA 100 to optimize gain and bandwidth of the PAE 112 with the antenna slot 114. In this example, the cavities 600 and 602 may be air filled with the portion 608 above the inner conductor 110 separating the cavities 600 and 602.

Figure 7:
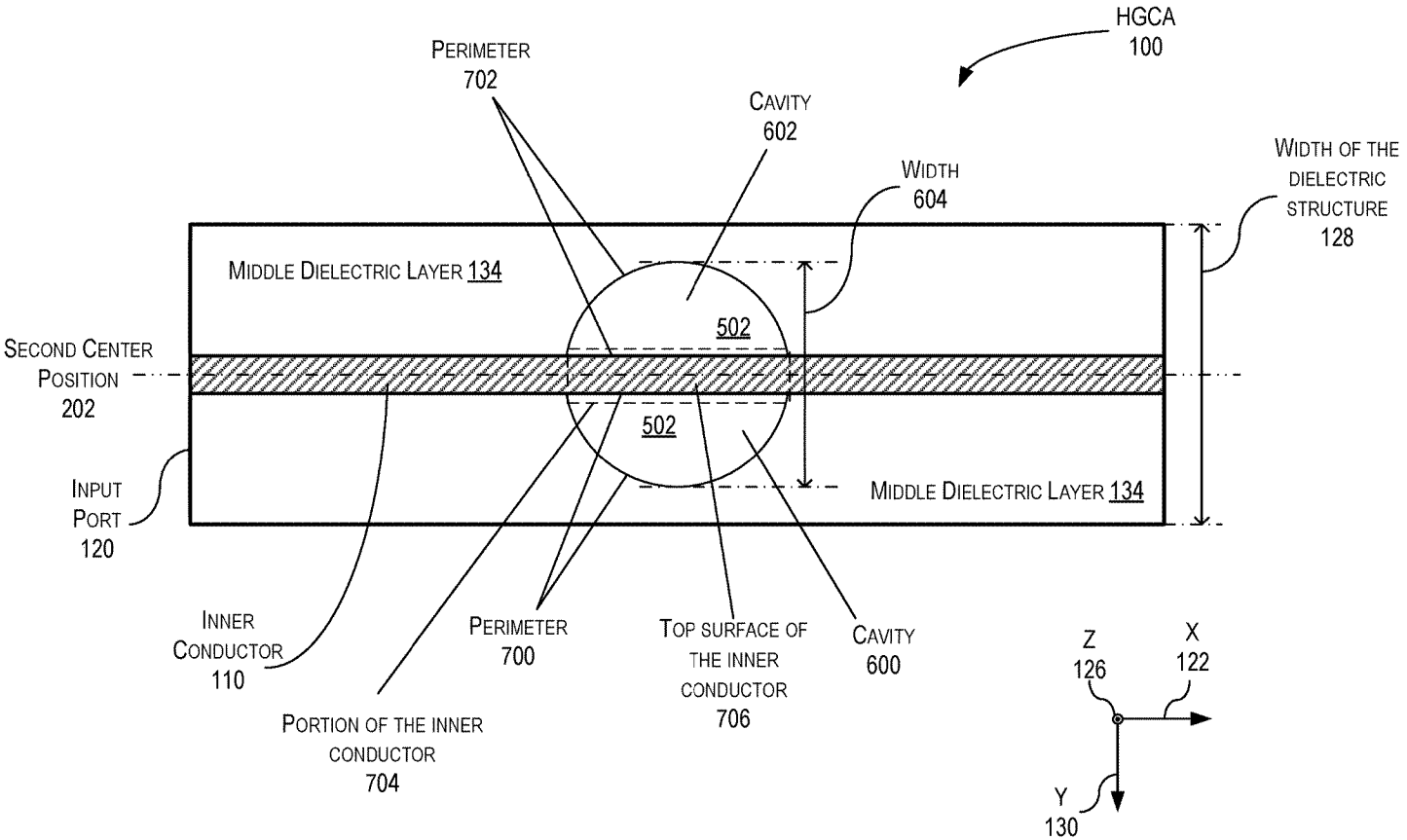
FIG. 7 is a top cut-away view (along cutting plane AA') showing the inner conductor running along the HGCA length (in the direction of the X-axis) in an example of an implementation of the cavities (shown in FIG. 6) in accordance with the present disclosure.

FIG. 7 is a top cut-away view (along cutting plane AA' 206) showing the inner conductor 110 running along the HGCA 100 length (in the direction of the X-axis 122) in an example of an implementation of the two cavities 600 and 602 (shown in FIG. 6) in accordance with the present disclosure. In this example, the inner conductor 110 is shown to be in the middle dielectric layer 134 of the laminated dielectric structure 104 between two other dielectric layers (not shown). The two cavities 600 and 602 are also shown within the middle dielectric layer 134.

In this example, the first cavity 600 has a first perimeter 700 with a portion that runs along a first side of the inner conductor 110 and the second cavity 602 has a second perimeter 702 that with a portion that runs along a second side of the inner conductor 110. The combined width of the first cavity 600, second cavity 602, and the inner conductor 110 is equal to the combined width 604. In this example, the cavities 600 and 602 are shown cut through the middle dielectric layer 134 exposing the top surface 502 of the dielectric layer below the middle dielectric layer 134. As in the example shown in FIG. 4, the cavities 600 and 602 are located below the PAE 112. The cavities 600 and 602 are air filled and are adjacent to a portion 704 of the inner conductor 110 and separated by the portion 608 of the middle dielectric layer 134.

Figure 8:
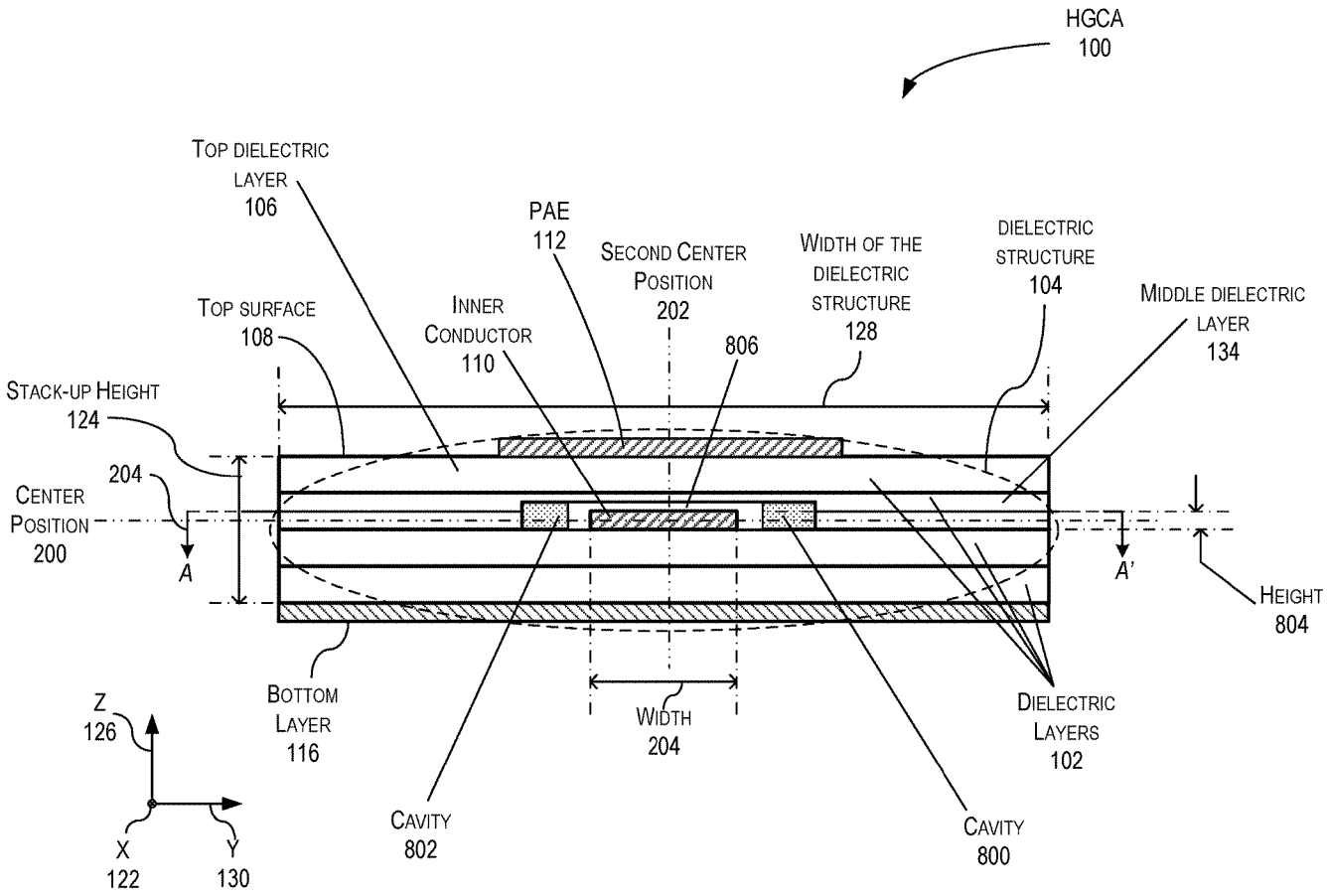
FIG. 8 is a cut-away view (along cutting plane BB') of the HGCA of an example of an implementation of the PAE and more than two cavities exclusive of the inner conductor in accordance with the present disclosure.

In FIG. 8, a cut-away view (along cutting plane BB' 306) of the HGCA 100 of an example of an implementation of more than two cavities 800 and 802 exclusive of the inner conductor 110 is shown in accordance with the present disclosure. In this example, the HGCA 100 includes more than two cavities 800 and 802 within the middle dielectric layer 134 but not co-located with (i.e., exclusive of) the inner conductor 110. The cavities (including cavities 800 and 802) with the inner conductor 110 have an equivalent combined width 904 (shown in FIG. 9).

In this example, the plurality of cavities may be circular and have small diameters that when combined form the combined width. The number of cavities, the diameter size of the individual cavities, and their respective location under the PAE 112 are predetermined based on the design of the HGCA 100 to optimize gain and bandwidth of the PAE 112 with the antenna slot 114. In this example, the cavities may be air filled and a portion 806 of the middle dielectric layer 134 may be located above and around the inner conductor 110 separating the individual cavities from each other.

Figure 9:
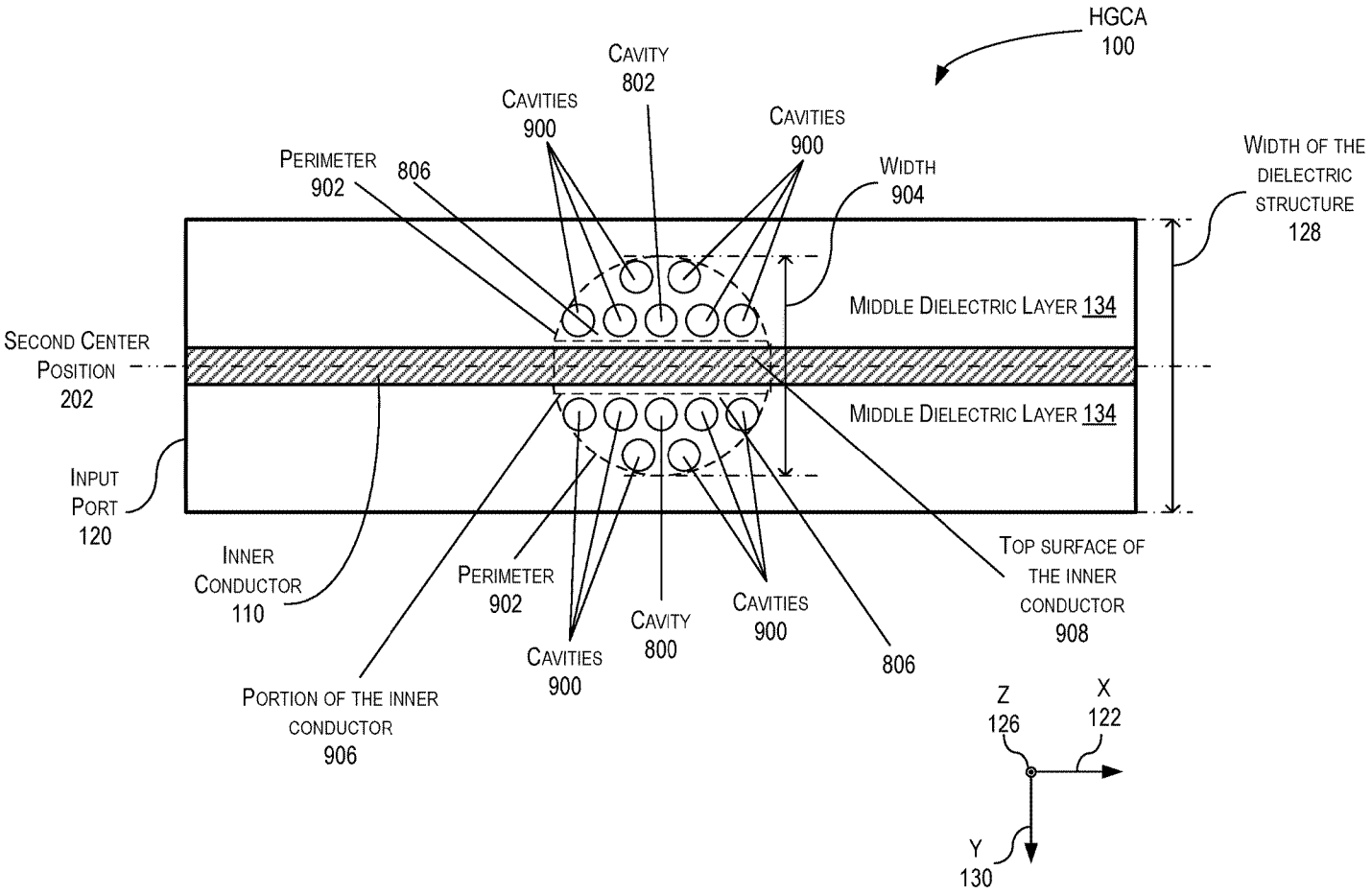
FIG. 9 is a top cut-away view (along cutting plane AA') of the HGCA showing the inner conductor running along the HGCA length in an example of an implementation of more than two cavities exclusive of the inner conductor in accordance with the present disclosure.

FIG. 9 is a top cut-away view (along cutting plane AA' 206 shown in FIG. 2) showing the inner conductor 110 running along the HGCA 100 length (in the direction of the X-axis 122) in an example of an implementation of plurality of cavities (including cavities 800 and 802 shown in FIG. 8) in accordance with the present disclosure. In this example, the inner conductor 110 is shown to be in the middle dielectric layer 134 of the laminated dielectric structure 104 between two other dielectric layers (not shown). The two cavities 800 and 802 are also shown within the middle dielectric layer 134 with numerous other cavities 900.

In this example, the combined area of the plurality of cavities (i.e., cavities 800, 802, and 900) has a perimeter 902 that may be approximately circular having a diameter that corresponds to the combined width 904 of the plurality of cavities. In this example, the plurality of cavities are shown through the middle dielectric layer 134 exposing the top surface of the dielectric layer below the middle dielectric layer 134. As in the example shown in FIGS. 4, 6, and 8, the location of the plurality of cavities is below the PAE 112. In this example, no cavities are co-located along the inner conductor 110. The cavities 800, 802, and 900 are air filled and are adjacent to a portion 906 of the inner conductor 110. In other words, the plurality of cavities 800, 802, and 900 are located within the middle dielectric layer 134 and the area surround by the perimeter 902 but are not co-located over a top surface 908 of the inner conductor 110.

Figure 10:
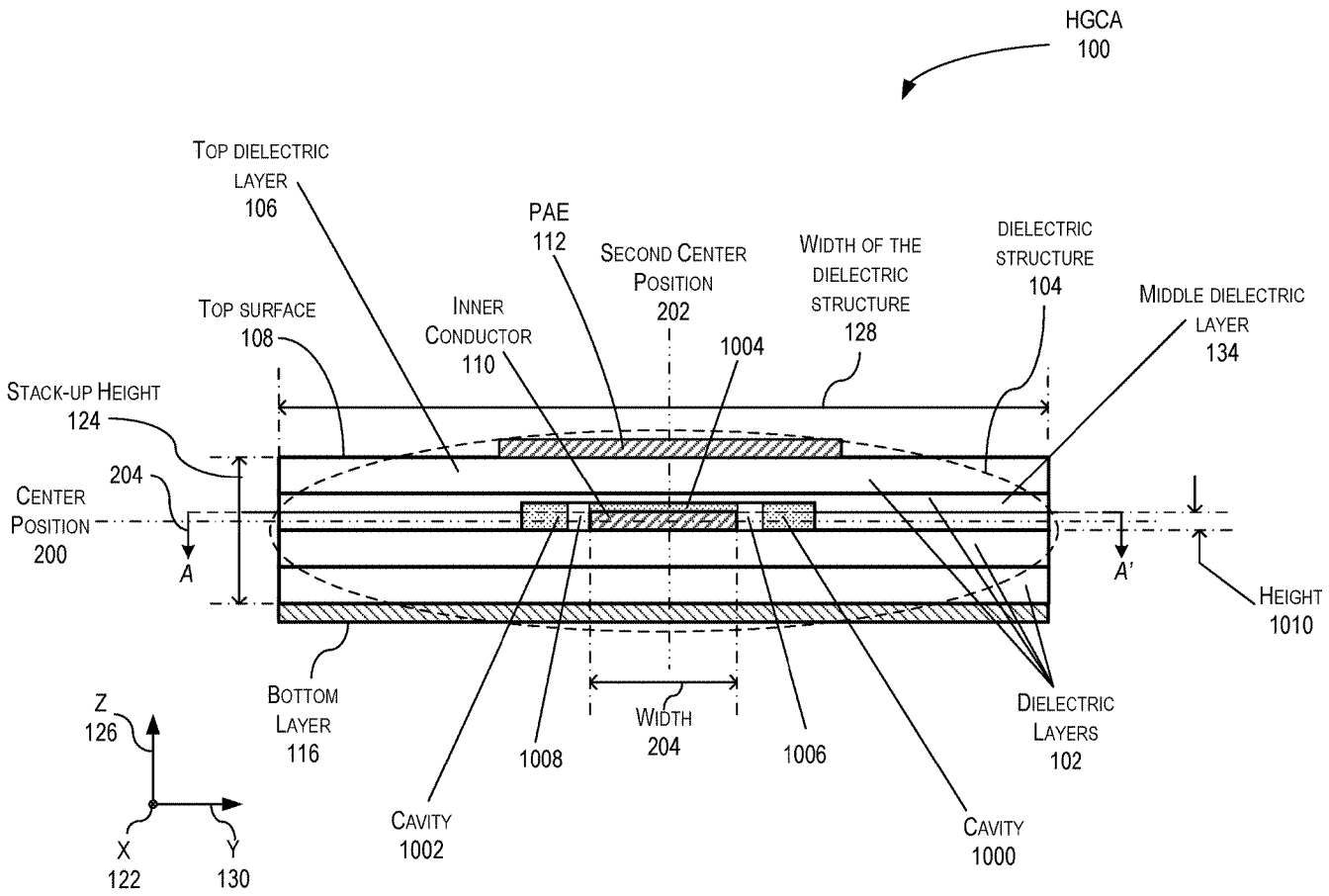
FIG. 10 is a cut-away view (along cutting plane BB') of the HGCA of an example of an implementation of the PAE and more than two cavities inclusive of the inner conductor in accordance with the present disclosure.

In FIG. 10, a cross-sectional view (along cutting plane BB' 306) of the HGCA 100 of an example of an implementation of more than two cavities 1000, 1002, and 1004 inclusive of the inner conductor 110 is shown in accordance with the present disclosure. In this example, the HGCA 100 includes the more than two cavities 1000, 1002, and 1004 within the middle dielectric layer 134 inclusive of the inner conductor 110. In this example, cavity 1004 is co-located with and above the inner conductor 110 and are separated by portions 1006 and 1008 of the middle dielectric layer 134.

Figure 11:
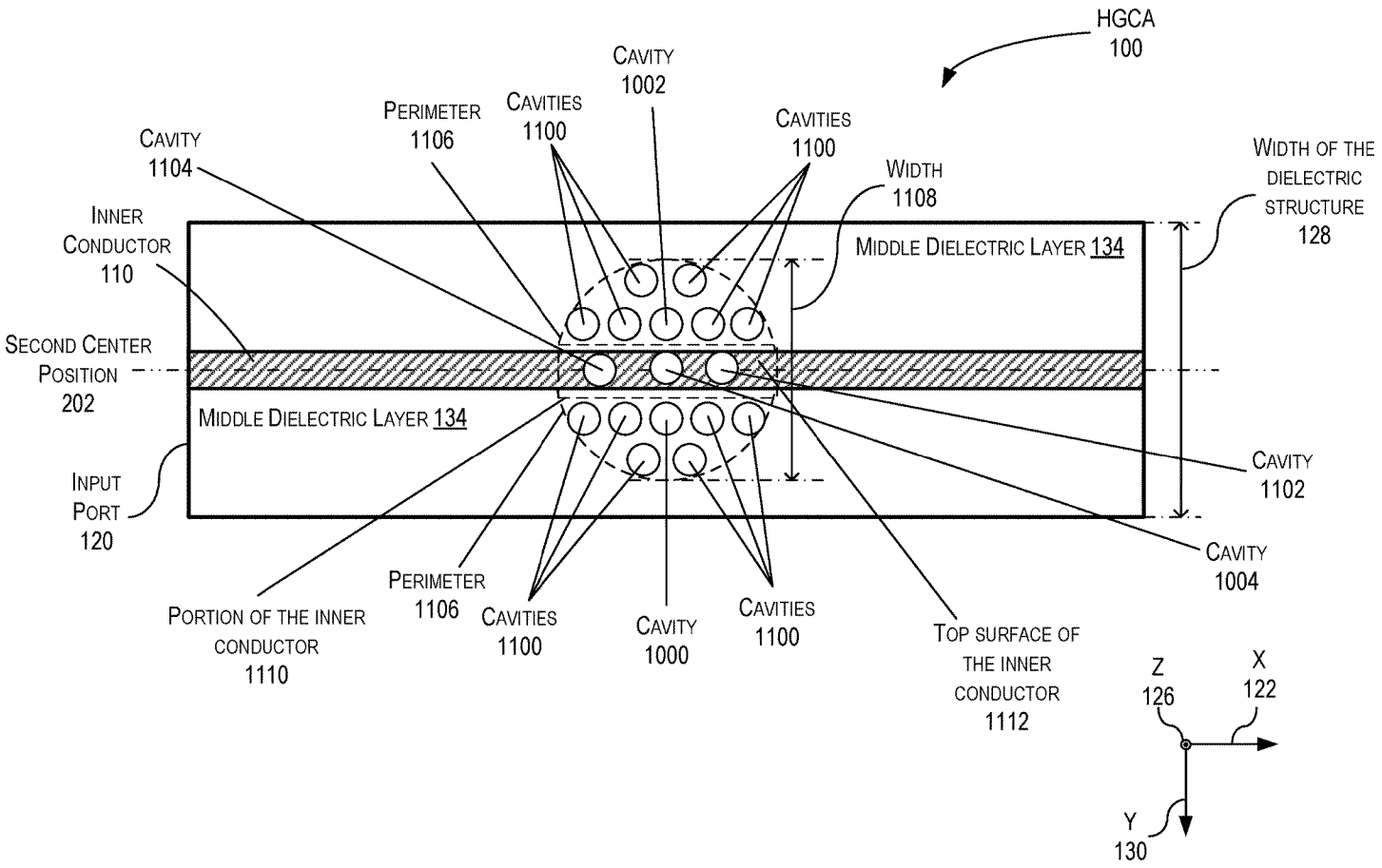
FIG. 11 is a top cut-away view (along cutting plane AA') of the HGCA showing the inner conductor running along the HGCA length in an example of an implementation of more than two cavities inclusive of the inner conductor in accordance with the present disclosure.

In this example, the plurality of cavities may be circular and have small diameters that when combined form the combined width 1108 (shown in FIG. 11). The number of cavities, the diameter size of the individual cavities, and their respective location under the PAE 112 are predetermined based on the design of the HGCA 100 to optimize gain and bandwidth of the PAE 112 and the antenna slot 114. In this example, the cavities may be an air filled.

FIG. 11 is a top cut-away view (along cutting plane AA' 206 shown in FIG. 2) showing the inner conductor 110 running along the HGCA 100 length (in the direction of the X-axis 122) in an example of an implementation of a plurality of cavities (including cavities 1000, 1002, and 1004 shown in FIG. 10) inclusive of the inner conductor 110 in accordance with the present disclosure. In this example, the inner conductor 110 is shown to be in the middle dielectric layer 134 of the laminated dielectric structure 104 between two other dielectric layers (not shown). The two cavities 1000 and 1002 are also shown within the middle dielectric layer 134 with numerous cavities 1100 and cavities 1004, 1102 and 1104. In this example, cavity 1004 and cavities 1102 and 1104 are shown co-located with and above the inner conductor 110—i.e., they are shown inclusive of the inner conductor 110.

In this example, the combined area of the plurality of cavities (i.e., cavities 1000, 1002, 1004, 1100, 1102, and 1104) has a perimeter 1106 that may be approximately circular having a diameter that corresponds to combined width 1108 of the plurality of cavities. In this example, the plurality of cavities are shown through the middle dielectric layer 134 exposing the top surface of the dielectric layer below the middle dielectric layer 134. As in the example shown in FIGS. 4, 6, 8, and 10, the location of the plurality of cavities is below the PAE 112. Unlike the example described in regard to FIG. 8, in this example, a sub-plurality (i.e., some) of the cavities (i.e., cavities 1004, 1102, and 1104) are co-located with the inner conductor 110. The plurality of cavities may be air filled and are both adjacent to a portion 1110 of the inner conductor 110 and co-located on top of a top surface 1112 of the inner conductor 110.

Figure 12:
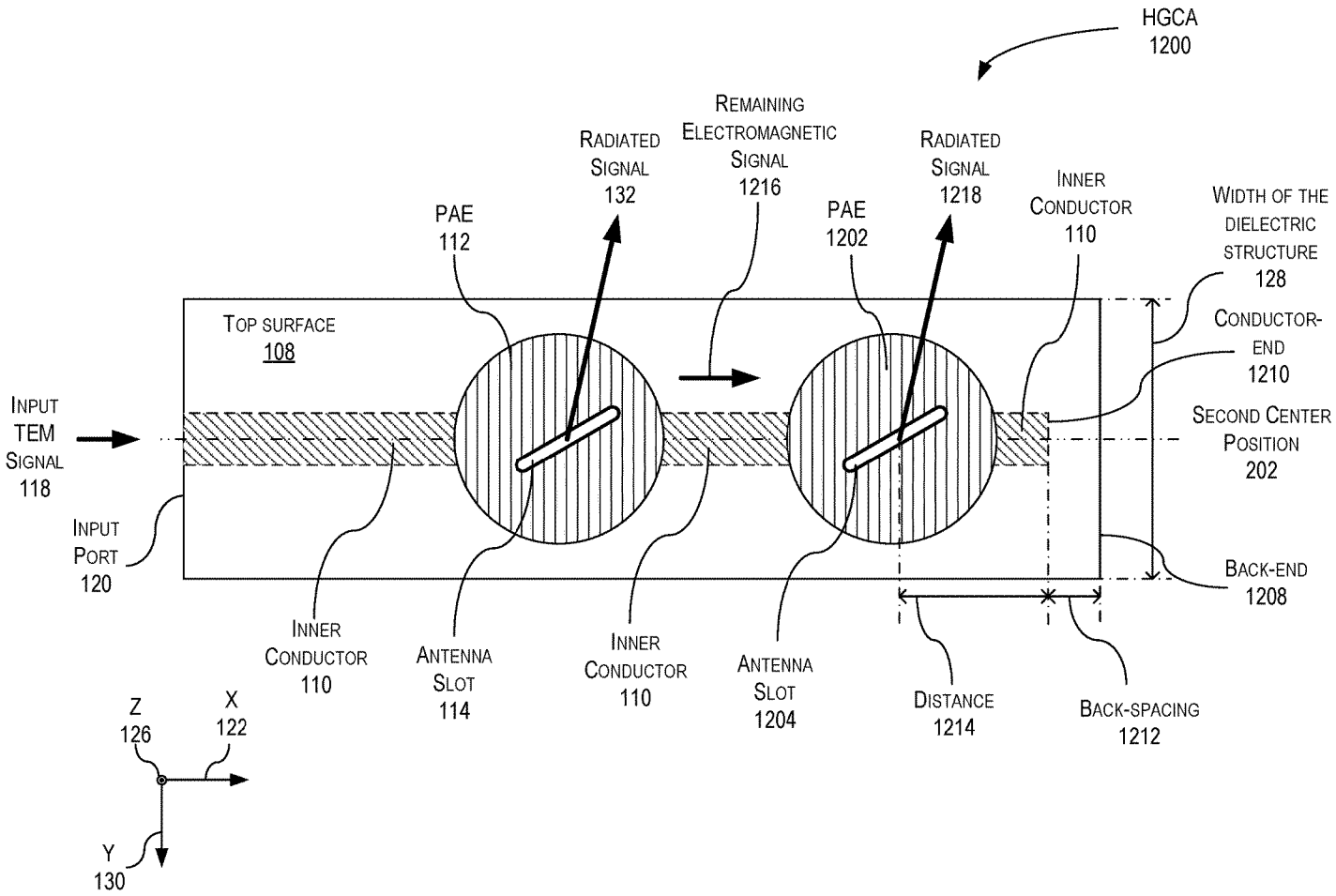
FIG. 12 is a top view of an example of an implementation of the HGCA with antenna elements fed serially in accordance with the present disclosure.

In FIG. 12, a top view of an example of an implementation of the HGCA 1200 is shown in accordance with the present disclosure. In this example, the HGCA 1200 is a serially fed 2×1 array that includes a second PAE 1202 on the top surface 108 with a second antenna slot 1204 within second PAE 1202. In this example, the hidden inner conductor 110 is shown through the top surface 108 to illustrate the example location/position of the first PAE 112 with the first antenna slot 114 and the second PAE 1202 with the second antenna slot 1204 in relation to the position of the inner conductor 110 along the second center position 202. It is appreciated by those of ordinary skill that the HGCA 1200 illustrated is not drawn to scale. In addition, under both the first PAE 112 and the second PAE 1202 is at least one cavity (not shown) as described earlier and shown in FIGS. 4-11.

In general, the inner conductor 110 extends from the input port 120 along the length of the HGCA 1200 to a back-end 1208 of the HGCA 1200, where the inner conductor 110 has a conductor-end 1210 that may optionally extend completely to the back-end 1208 or at a back-spacing distance 1212 from the back-end 1208 that is pre-determined by the design of the HGCA 1200 to optimize the electrical performance of the HGCA 1200. Moreover, the conductor-end 1210 may be positioned within the HGCA 1200 at a pre-determined distance 1214 from the center of the second PAE to optimize the amount of energy coupled from the microstrip or stripline, the first PAE 112 with the first antenna slot 114 and second PAE 1202 with the second antenna slot 1204.

In an example of operation, the first electromagnetic signal (produced by the input TEM signal 118) is injected into the input port 120 and propagates along the length of the HGCA 1200. When the electromagnetic signal reaches the first PAE 112 with the first antenna slot 114 a portion of the electromagnetic signal produces a first radiated signal 132. The remaining electromagnetic signal 1216 then propagates towards the second PAE 1202 with the second antenna slot 1204. When the remaining electromagnetic signal 1216 reaches the second PAE 1202 with the second antenna slot 1204 a portion of the electromagnetic signal 1216 produces a second radiated signal 1218.

Figure 13:
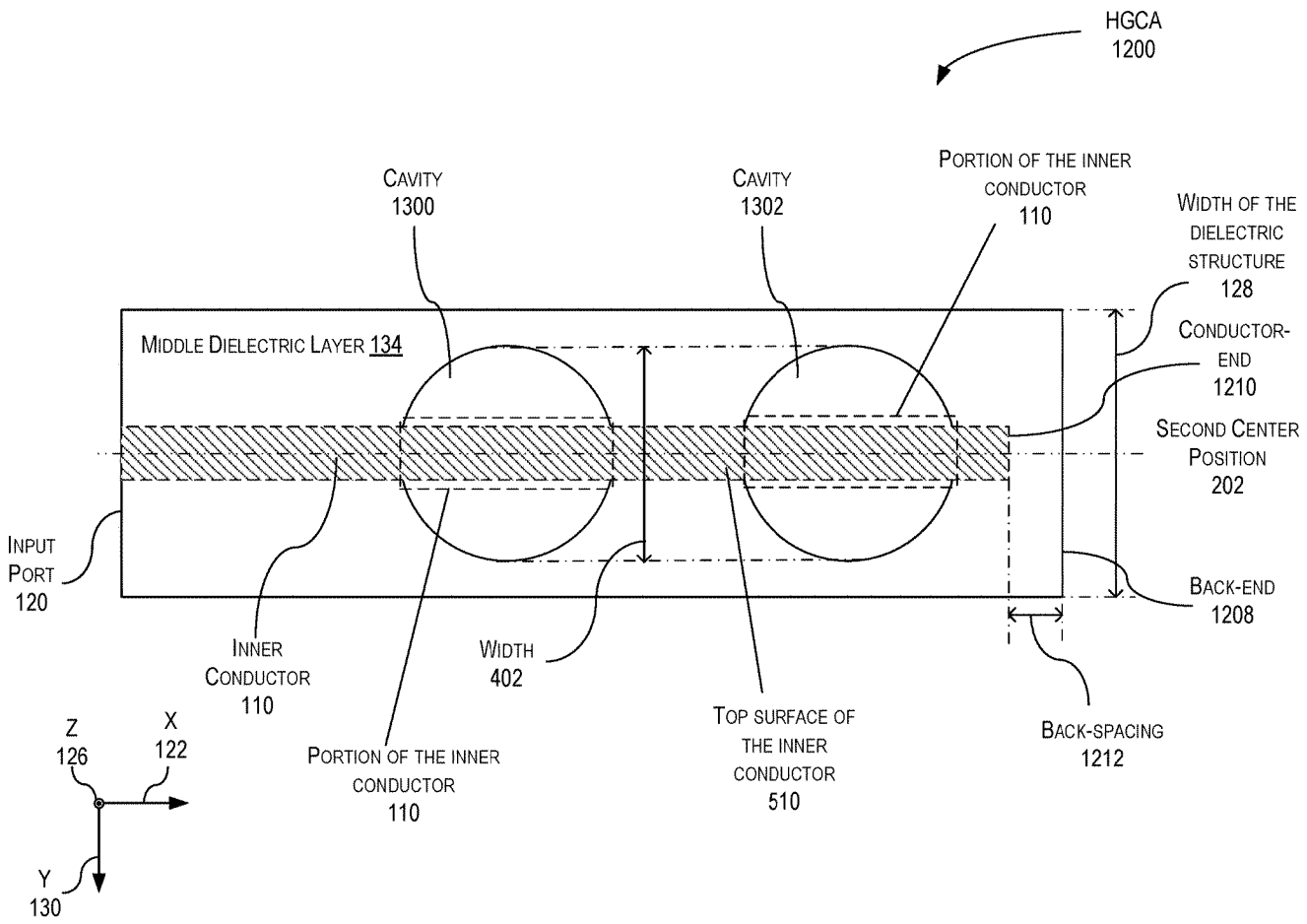
FIG. 13 is a top cut-away view (along cutting plane AA') of the HGCA (shown in FIG. 12) showing the inner conductor running along the HGCA length and an example of an implementation of at least two cavities in accordance with the present disclosure.

FIG. 13 is a top cut-away view (along cutting plane AA' 206 shown in FIG. 2) showing the inner conductor 110 running along the HGCA 1200 length (in the direction of the X-axis 122) in an example of an implementation of at least two cavities in accordance with the present disclosure. In this example, the HGCA 1200 includes a first cavity 1300 and a second cavity 1302 formed within the dielectric structure 104 that are located under the first PAE 112 and second PAE 1202, respectively. In this example, both the first cavity 1300 and second cavity 1302 are assumed to be the same as the cavity 400 described earlier in relation to FIG. 4. However, it is appreciated that the first cavity 1300 and second cavity 1302 may alternatively be implemented as the first cavity 600 and second cavity 602 (described earlier in relation to FIG. 7), the plurality of cavities 800, 802, and 900 (described earlier in relation to FIG. 9), or the plurality of cavities 1000, 1002, 1004, 1100, 1102, and 1104 described earlier in relation to FIG. 11.

Figure 14:
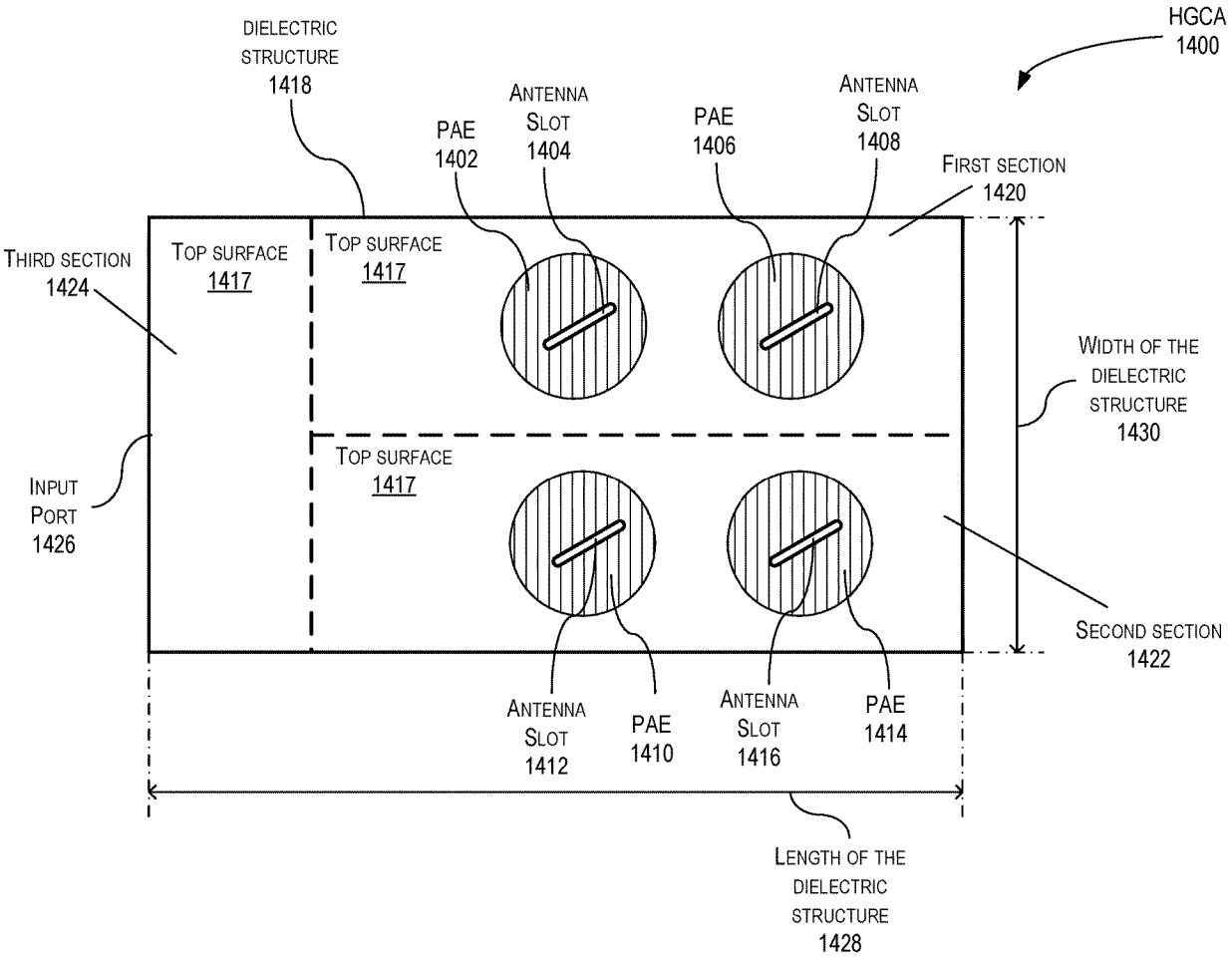
FIG. 14 is a top view of an example of yet another implementation of the HGCA with antenna elements fed in a serial and parallel combination in accordance with the present disclosure.

In FIG. 14, a top view of an example of yet another implementation of the HGCA 1400 is shown in accordance with the present disclosure. In this example, the HGCA 1400 is a parallel and serially fed combination 2×2 array that includes a first PAE 1402 with a first antenna slot 1404, a second PAE 1406 with a second antenna slot 1408, a third PAE 1410 with a third antenna slot 1412, and a fourth PAE 1414 with a fourth antenna slot 1416. In this example, as described earlier, the first PAE 1402, second PAE 1406, third PAE 1410, and fourth PAE 1414 are located on the top surface 1417 of the top dielectric layer of the dielectric structure 1418. Additionally, the first antenna slot 1404 is located within the first PAE 1402, the second antenna slot 1408 is located within the second PAE 1406, the third antenna slot 1412 is located within the third PAE 1410, and the fourth antenna slot 1416 is located within the fourth PAE 1414. Moreover, in this example, the top surface 1417 is shown divided into three sections that include a first section 1420, second section 1422, and third section 1424. The first PAE 1402 with the first antenna slot 1404 and the second PAE 1406 with the second antenna slot 1408 are located within the first section 1420 along with a first microstrip or stripline (not shown) that is covered by the top surface 1417. The third PAE 1410 with the third antenna slot 1412 and the fourth PAE 1414 with the fourth antenna slot 1416 are located within the second section 1422 along with a second microstrip or stripline (not shown) that is also covered by the top surface 1417. In this example, the first and second microstrips each include an inner conductor and bottom layer (e.g., inner conductor 110 and bottom layer 116 shown in FIGS. 1 and 2). In the third section 1424, the HGCA 1400 includes a power divider (not shown) that is located in a middle dielectric layer (not shown) and is also covered by the top surface 1417. The power divider is electrically connected to an input port 1426. In this example, the inner conductors of the first and second microstrips are electrically connected to the power divider and the bottom layer is a conductor that extends the entire length 1428 and width 1430 of the dielectric structure 1418.

Figure 15:
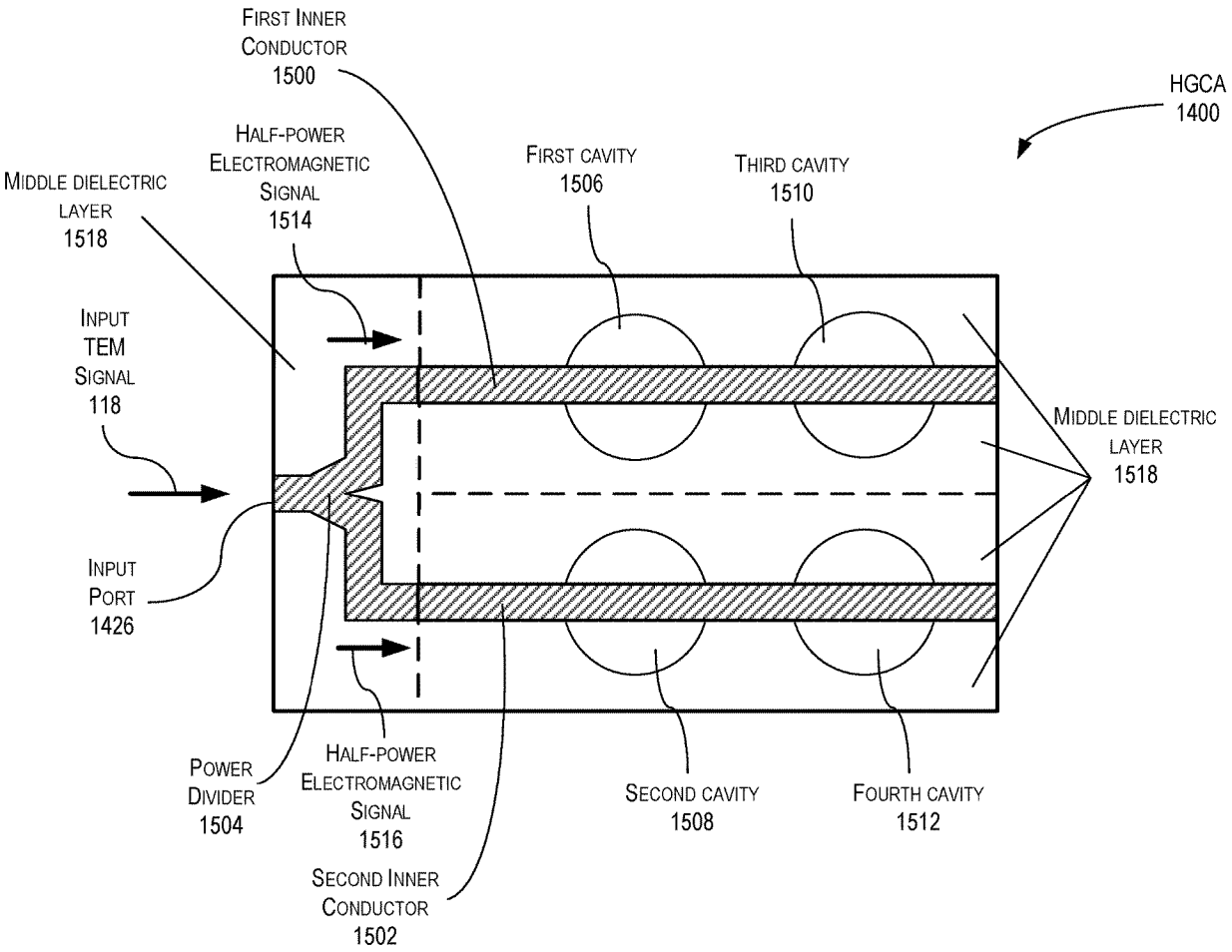
FIG. 15 is a top cut-away view of the HGCA (shown in FIG. 14) showing an example of an implementation of the first inner conductor, the second inner conductor, a power divider, and four cavities in accordance with the present disclosure.

In FIG. 15, a top cu-way view of the HGCA 1400 (shown in FIG. 14) showing an example of an implementation of the first inner conductor 1500, the second inner conductor 1502, power divider 1504, and at least two cavities (i.e., first cavity 1506 and second cavity 1508) in accordance with the present disclosure. In this example, an optional third cavity 1510 and fourth cavity 1512 are also shown. In this example, the power divider 1504 may be a microstrip or stripline type of power divider that divides the input TEM signal 118 at the input port 1426 into two equal half-power input electromagnetic signals (i.e., first and second half-power electromagnetic signals 1514 and 1516) that are injected into the first inner conductor 1500 and second inner conductor 1502, respectively. In this example, the first cavity 1506, second cavity 1508, third cavity 1510, and fourth cavity 1512 are formed within the middle dielectric layer 1518 of the dielectric structure 1418 such that the first cavity 1506 and third cavity 1510 are co-located under the first PAE 1402 and second PAE 1406, respectively; and the second cavity 1508 and fourth cavity 1512 are co-located under the third PAE 1410 and fourth PAE 1414, respectively.

In this example, the first cavity 1506 and the second cavity 1508 may be implemented as the cavity 400 (described earlier in relation to FIG. 4) having a single cavity surrounding a portion of the first inner conductor 1500 and second inner conductor 1502, respectively. However, it is appreciated that the first cavity 1506 and second cavity 1508 may alternatively be implemented as the first cavity 600 and second cavity 602 (described earlier in relation to FIG. 7), the plurality of cavities 800, 802, and 900 (described earlier in relation to FIG. 9), or the plurality of cavities 1000, 1002, 1004, 1100, 1102, and 1104 (described earlier in relation to FIG. 11). Similarly, the third cavity 1510 and fourth cavity 1512 may each also be implemented as a single cavity (similar to cavity 400) or alternatively implemented as the first cavity 600 and second cavity 602 (described earlier in relation to FIG. 7), the plurality of cavities 800, 802, and 900 (described earlier in relation to FIG. 9), or the plurality of cavities 1000, 1002, 1004, 1100, 1102, and 1104 (described earlier in relation to FIG. 11). In any of these implementations, the combination of the first inner conductor 1500, first cavity 1506, and third cavity 1510 may be implemented as described earlier in relation to FIGS. 12 and 13. Similarly, the combination of the second inner conductor 1502, second cavity 1508, and fourth cavity 1512 may also be implemented as described earlier in relation to FIGS. 12 and 13.

Figure 16:
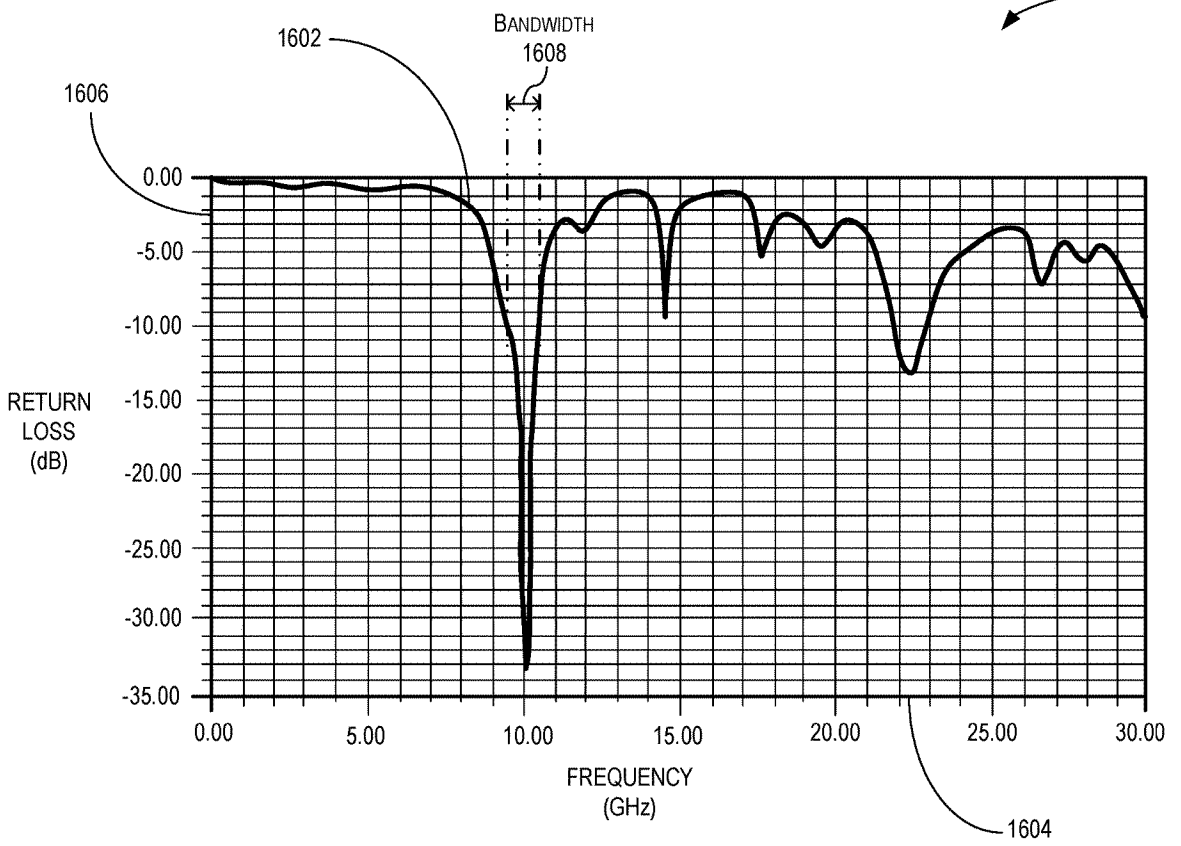
FIG. 16 is a graph of a plot of an example of the predicted return loss performance of the HGCA (shown in FIGS. 14 and 15) as a function of frequency in accordance with the present disclosure.

As an example of operation, in FIG. 16, a graph 1600 of a plot 1602 is shown of an example of return loss performance of the HGCA 1400 (shown in FIGS. 14 and 15) as a function of frequency in accordance with the present disclosure. In this example, the horizontal axis 1604 represents the frequency in gigahertz ("GHz") and the vertical axis 1606 represents the return loss in decibels ("dB"). The horizontal axis 1604 varies from 0 to 30 GHz and the vertical axis 1606 varies from −35 to 0 dB. In this example, the HGCA 1400 is a 2×2 circular patch array designed to operate at 10 GHz with a resulting bandwidth 1608 of approximately 1.55 GHz.

Figure 17:
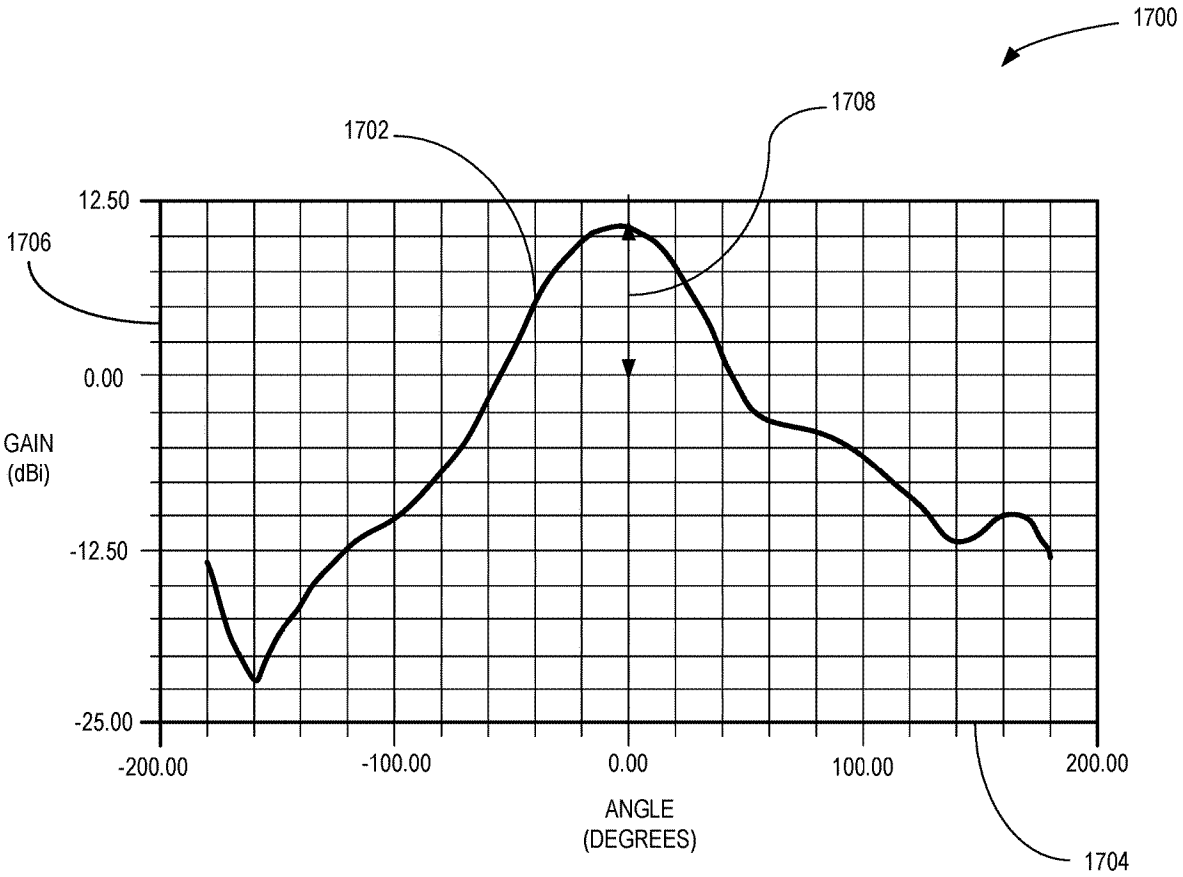
FIG. 17 is a graph of a plot of an example of the predicted gain performance of the HGCA (shown in FIGS. 14 and 15) as a function of elevation angle in accordance with the present disclosure.

In FIG. 17, a graph 1700 of a plot 1702 is shown of an example of the gain performance of the HGCA 1400 as a function of the elevation angle in accordance with the present disclosure. Similar to FIG. 16, in this example, the horizontal axis 1704 represents the elevation angle in degrees and the vertical axis 1706 represents the gain in decibels-isotropic ("dBi"). The horizontal axis 1704 varies from −200 to 200 degrees and the vertical axis 1706 varies from −25 to 12.5 dBi. Again, in this example, the HGCA 1400 is a 2×2 circular patch array designed to operate at 10 GHz with a resulting predicted gain 1708 of approximately 10.1 dBi, which is approximately an 18% increase in gain-bandwidth product ("GBWP") over an equivalent non-cavity 2×2 circular patch array designed to operate at 10 GHz.

Turning to FIGS. 18A-18G, a stack-up method for fabricating the HGCA (i.e., either HGCA 100, 1200, or 1400) utilizing a lamination process is shown. Specifically, in FIG. 18A, a cross-sectional view of a first section 1800 of the HGCA is shown in accordance with the present disclosure. The first section 1800 of the HGCA includes a first dielectric layer 1802 with a first conductive layer 1804 patterned on a bottom surface 1808 of the first dielectric layer 1802 where the first dielectric layer 1802 has a top surface 1806 and the bottom surface 1808. In this example, the first conductive layer 1804 is the bottom layer (i.e., bottom layer 116). Moreover, in this example, the first conductive layer 1804 may be constructed of a conductive metal such as, for example, electroplated copper or printed silver ink.

Figure 18A:
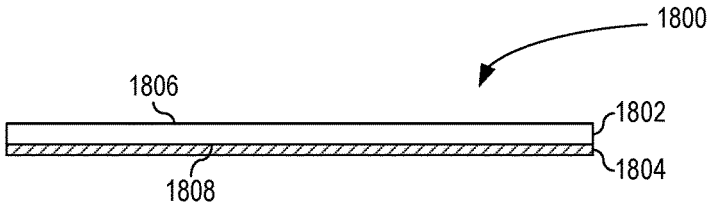
FIG. 18A is a cross-sectional view of a first section of the HGCA in accordance with the present disclosure.
Figure 18B:
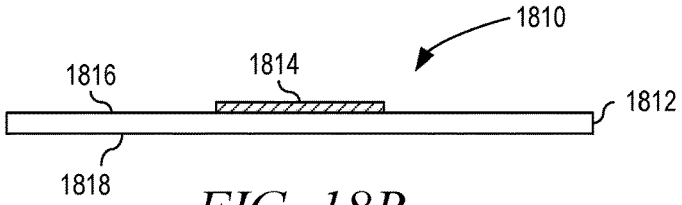
FIG. 18B is a cross-sectional view of a second section of the HGCA in accordance with the present disclosure.

In FIG. 18B, a cross-sectional view of a second section 1810 of the HGCA is shown in accordance with the present disclosure. The second section 1810 of the HGCA includes a second dielectric layer 1812 with a second conductive layer 1814 patterned on a top surface 1816 of the second dielectric layer 1812. In this example, the second conductive layer 1814 is an inner conductor (i.e., inner conductor 110) of the HGCA. In this example, the second conductive layer 1814 may be constructed of a conductive metal such as, for example, electroplated copper, or printed silver ink.

Figure 18C:
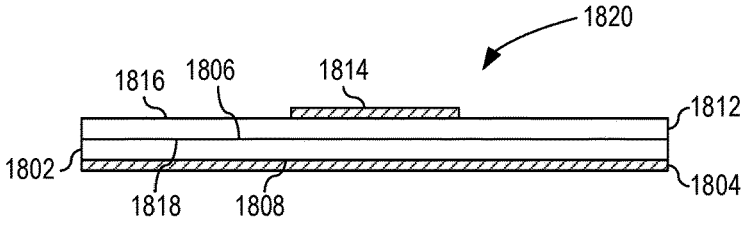
FIG. 18C is a cross-sectional view of a first combination of the first section and the second section of the HGCA in accordance with the present disclosure.

In FIG. 18C, a cross-sectional view of a first combination 1820 of the first section 1800 and the second section 1810 of the HGCA is shown in accordance with the present disclosure. The first combination 1820 is formed by laminating the bottom surface 1818 of the second dielectric layer 1812 to the top surface 1806 of the first dielectric layer 1802.

Figure 18D:
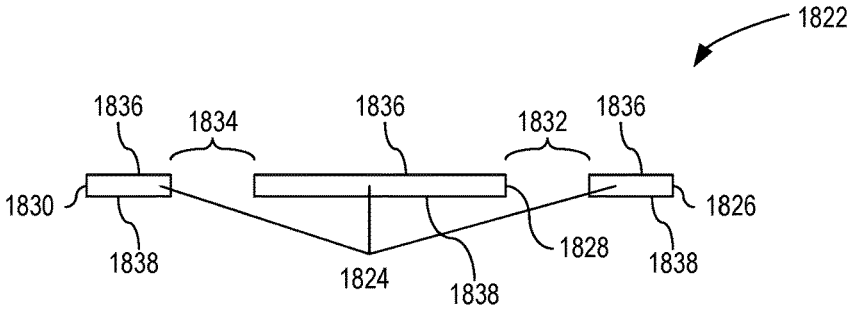
FIG. 18D is a cross-sectional view of a third section of the HGCA in accordance with the present disclosure.

In FIG. 18D, a cross-sectional view of a third section 1822 of the HGCA is shown in accordance with the present disclosure. The third section 1822 is a patterned third dielectric layer 1824 that corresponds to the middle dielectric layer 134 (described earlier in relation to FIGS. 1, 2, 4, 5, 6, 7, 8, 9, 10, 11, and 13) and middle dielectric layer 1518 (described earlier in relation to FIGS. 14 and 15). In this example, the third section 1822 (and by extension the third dielectric layer 1824) may include three or more sub-sections 1826, 1828, and 1830, which may be physically connected to each other (i.e., the gaps 1832 and 1834 correspond to the cavities described earlier). Furthermore, the third section 1822 may optionally include only two sub-sections 1826 and 1830 in order to produce a single cavity that surrounds the inner conductor 110 as described earlier in relation to FIGS. 4 and 5. In this example, the third dielectric layer 1824 includes a top surface 1836 and a bottom surface 1838.

Figure 18E:
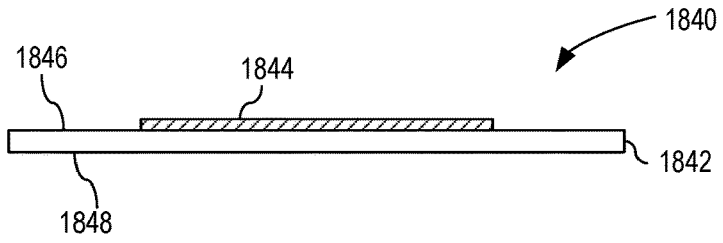
FIG. 18E is a cross-sectional view of a fourth section of the HGCA in accordance with the present disclosure.

In FIG. 18E, a cross-sectional view of a fourth section 1840 that includes a fourth dielectric layer 1842 of the HGCA and a third conductive layer 1844 is shown in accordance with the present disclosure. The fourth dielectric layer 1842 includes a top surface 1846 and a bottom surface 1848. The third conductive layer 1844 is patterned on the top surface 1846 of the fourth dielectric layer 1842. In this example, the third conductive layer 1844 is the PAE (i.e., PAE 112 described earlier in relation to FIGS. 1, 2, 3, 4, 6, 8, 10, and 12) of the HGCA. In this example, the third conductive layer 1844 may be constructed of a conductive metal such as, for example, electroplated copper, or printed silver ink. In this example, the fourth dielectric layer 1842 corresponds to the top dielectric layer 106 described earlier in relation to FIGS. 1, 2, 4, 6, 8, and 10.

Figure 18F:
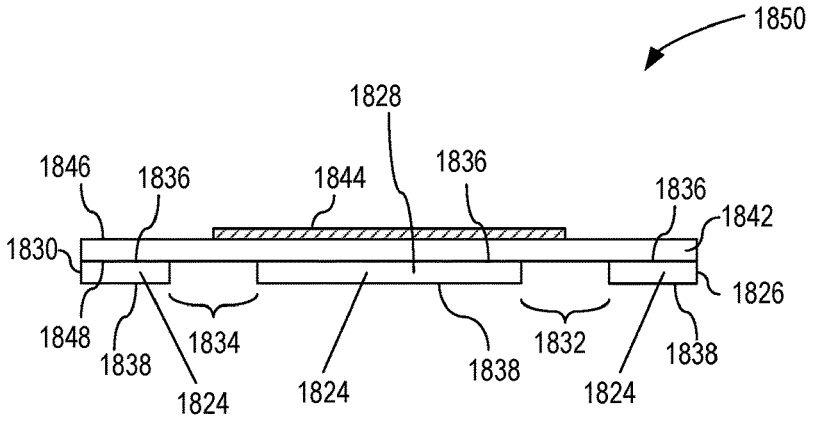
FIG. 18F is a cross-sectional view of a second combination that includes the fourth section and third dielectric layer of the HGCA in accordance with the present disclosure.

In FIG. 18F, a cross-sectional view of a second combination 1850 of the fourth section 1840 and the third dielectric layer 1824 of the HGCA is shown in accordance with the present disclosure. The second combination is formed by laminating the bottom surface 1848 of the fourth dielectric layer 1842 to the top surface 1836 of the third dielectric layer 1824. In this example, the third dielectric layer 1824 is shown as having the sub-sections 1826, 1828, and 1830, with first gap 1832, and second gap 1834 as described earlier in relation to FIG. 18D. It is appreciated by those of ordinary skill in the art that the number of sub-sections and gaps may vary based on the design of the HGCA.

Figure 18G:
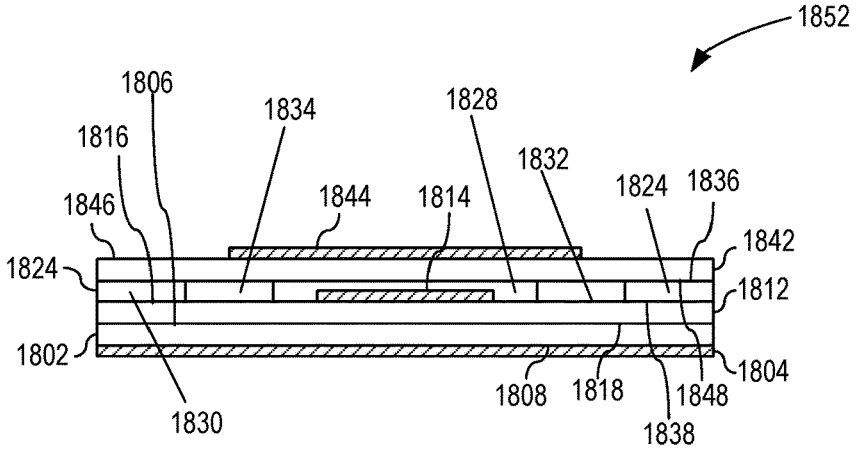
FIG. 18G is a cross-sectional view of a composite laminated structure that includes the first combination and a second combination of the HGCA in accordance with the present disclosure.

In FIG. 18G, a cross-sectional view of a composite laminated structure 1852 that includes the first combination 1820 and the second combination 1850 of the HGCA is shown in accordance with the present disclosure. In the composite laminated structure 1852 the bottom surface 1838 of the third dielectric layer 1824 is laminated on to the top surface 1816 of the second dielectric layer 1812 producing the composite laminated structure 1852 that is also the dielectric structure (e.g., dielectric structure 104 or 1418).

In these examples, the first dielectric layer 1802, second dielectric layer 1812, third dielectric layer 1824, and fourth dielectric layer 1842 may be constructed of an RF dielectric material. Moreover, each of these dielectric layers 1802, 1812, 1824, and 1842 may be laminated to each other and the second conductive layer 1814 with an adhesive tape or bonding film.

Figure 19:
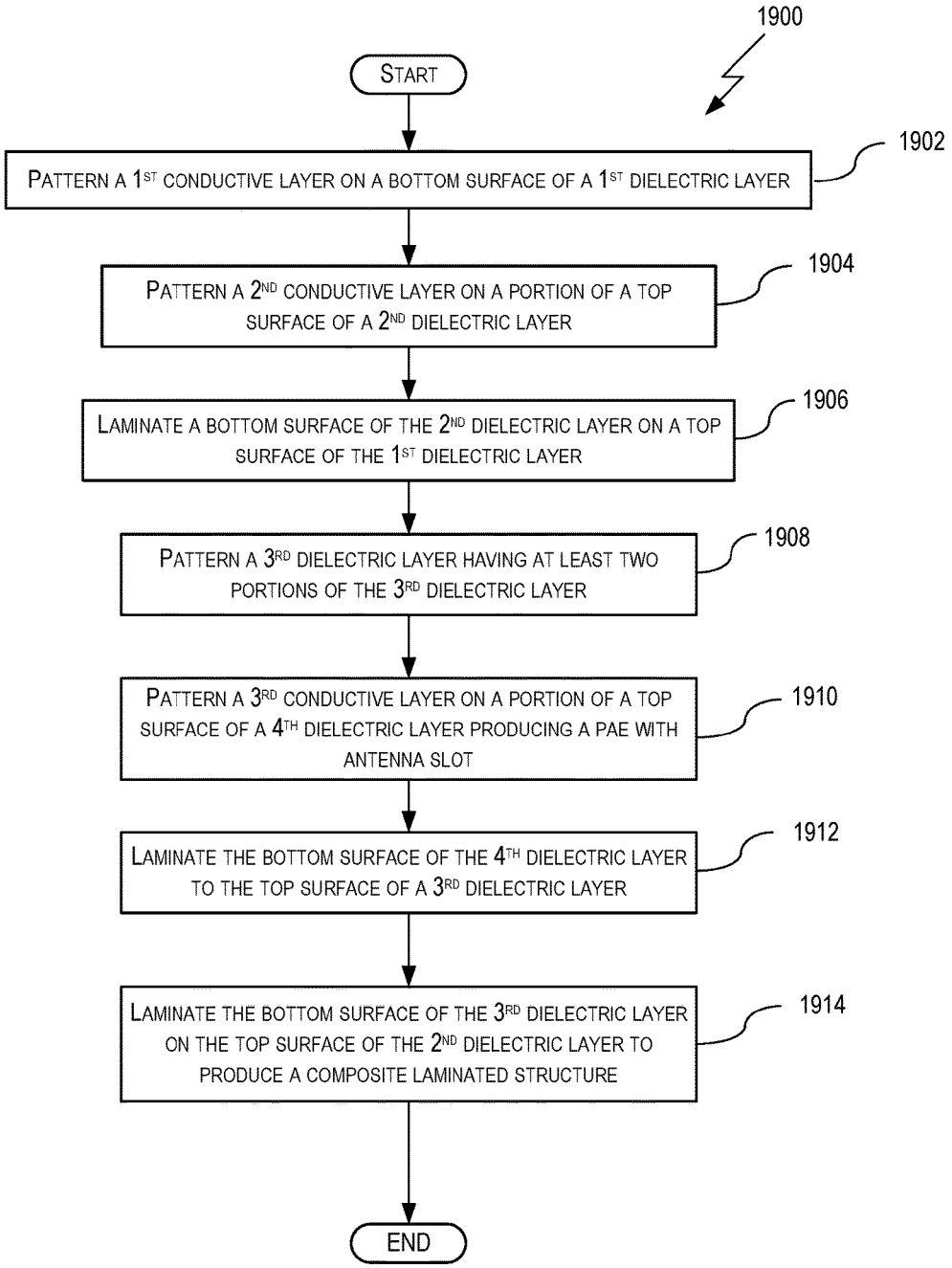
FIG. 19 is a flowchart of an example implementation of a method for fabricating the HGCA utilizing a lamination process in accordance with the present disclosure.

In FIG. 19, a flowchart is shown of an example implementation of a method 1900 for fabricating the HGCA utilizing a lamination process in accordance with the present disclosure. The method 1900 is for fabricating the HGCA (i.e., HGCA 100, 1200, or 1400) utilizing the lamination process described in FIGS. 18A-18G.

The method 1900 starts by patterning 1902 the first conductive layer 1804 on the bottom surface 1808 of a first dielectric layer 1802. The method 1900 additionally includes patterning 1904 the second conductive layer 1814 on the top surface 1816 of the second dielectric layer 1812 to produce an inner conductor 110. The method 1900 also includes laminating 1906 the bottom surface 1818 of the second dielectric layer 1812 to the top surface 1806 of the first dielectric layer 1802 and patterning 1908 the third dielectric layer 1824 having at least two portions 1826 and 1830 of the third dielectric layer 1824 with the top surface 1836 and the bottom surface 1838. The method 1900 further includes patterning 1910 the third conductive layer 1844 on the top surface 1846 of the fourth dielectric layer 1842 to produce the PAE 112 with antenna slot 114. Moreover, the method 1900 includes laminating 1912 the bottom surface 1838 of the fourth dielectric layer 1842 to the top surface 1836 of the third dielectric layer 1824 and laminating 1914 the bottom surface 1838 of the third dielectric layer 1824 to the top surface 1816 of the second dielectric layer 1812 to produce a composite laminated structure 1852. The method then ends.

In this example, the method 1900 may utilize a sub-method where one or more of the first conductive layer 1804, second conductive layer 1814, and third conductive layer 1844 are formed by a subtractive method (e.g., wet etching, milling, or laser ablation) of electroplated or rolled metals or by an additive method (e.g., printing or deposition) of printed inks or deposited thin films.

In FIGS. 20A-20G, a method for fabricating the HGCA (i.e., HGCA 100, 1200, or 1400) utilizing an additive 3-D printing process is shown. Specifically, in FIG. 20A, a cross-sectional view of first section 2000 of the HGCA is shown in accordance with the present disclosure. The first section 2000 of the HGCA includes a printed first conductive layer 2002 with a top surface 2004 and a first width 2006, where the first width 2006 has a first center 2008.

Figure 20A:
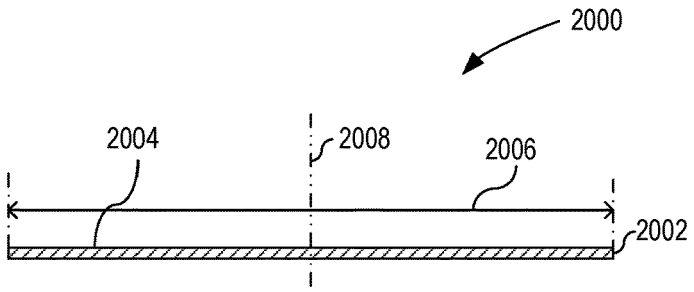
FIG. 20A is a cross-sectional view of a first section of the HGCA in accordance with the present disclosure.
Figure 20B:
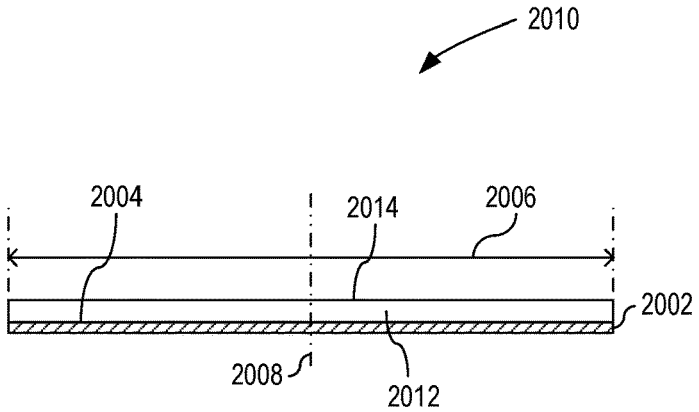
FIG. 20B is a cross-sectional view of a first combination of the first section and a printed first dielectric layer in accordance with the present disclosure.

In FIG. 20B, a cross-sectional view of a first combination 2010 of the first section 2000 with a printed first dielectric layer 2012 is shown in accordance with the present disclosure. In this example, the printed first dielectric layer 2012 with a top surface 2014 is printed on the top surface 2004 of the printed first conductive layer 2002.

Figure 20C:
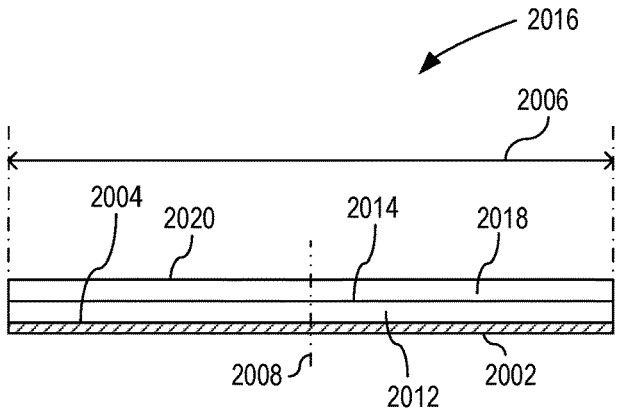
FIG. 20C is a cross-sectional view of a second combination of the first combination with a printed second dielectric layer is shown in accordance with the present disclosure.

In FIG. 20C, a cross-sectional view of a second combination 2016 of the first combination 2010 with a printed second dielectric layer 2018 is shown in accordance with the present disclosure. In this example, the printed second dielectric layer 2018 with a top surface 2020 is printed on the top surface 2014 of the printed first dielectric layer 2012.

Figure 20D:
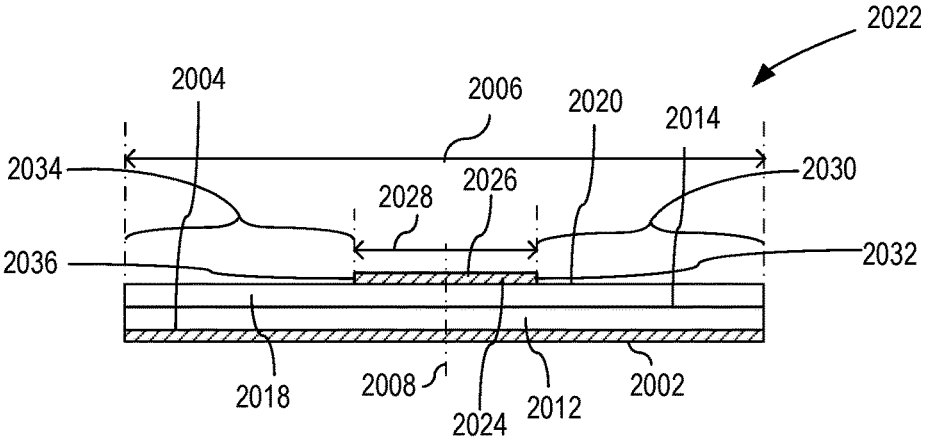
FIG. 20D is a cross-sectional view of a third combination of the second combination with a printed second conductive layer is shown in accordance with the present disclosure.

In FIG. 20D, a cross-sectional view of a third combination 2022 of the second combination 2016 with a printed second conductive layer 2024 is shown in accordance with the present disclosure. Specifically, the printed second conductive layer 2024 with a top surface 2026 and second width 2028 less than the first width 2006 is printed on the top surface 2020 of the second dielectric layer 2018. In this example, the second width 2028 is less than the third width 2008. The second width 2028 results in a first gap 2030 at a first end 2032 of the second conductive layer 2024 and a second gap 2034 at a second end 2036 of the second conductive layer 2024, where the top surface 2020 of the second dielectric layer 2018 is exposed.

Figure 20E:
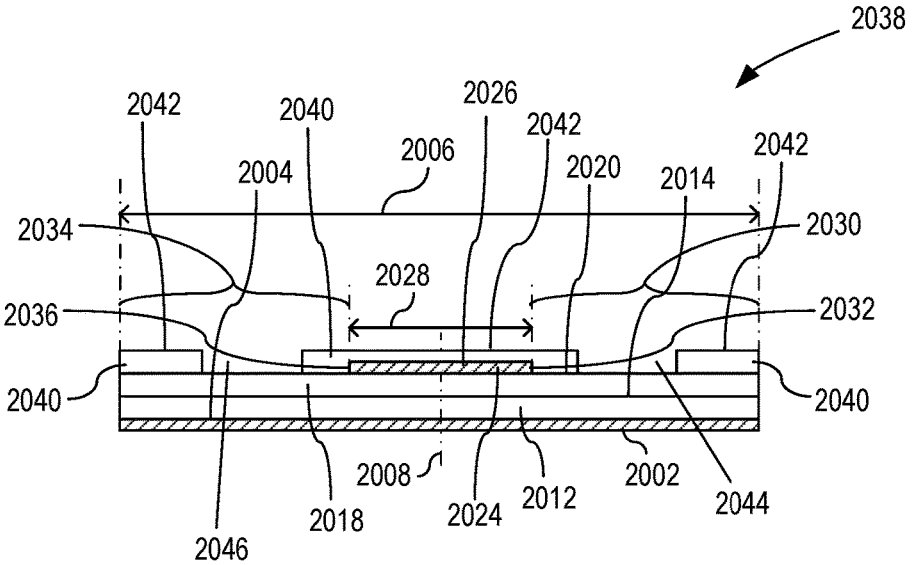
FIG. 20E is a cross-sectional view of a fourth combination of the third combination with a printed third dielectric layer in accordance with the present disclosure.

In FIG. 20E, a cross-sectional view of a fourth combination 2038 of the third combination 2022 with a printed third dielectric layer 2040 is shown in accordance with the present disclosure. Specifically, the printed third dielectric layer 2040 is printed on the top surface 2026 of the printed second conductive layer 2024 and the top surface 2020 of the printed second dielectric layer 2018 though the first gap 2030 and second gap 2034. In this example, the printed third dielectric layer 2040 has a top surface 2042 and includes a first cavity 2044 and a second cavity 2046 within the printed third dielectric layer 2040. In this example, the third dielectric layer 2040 corresponds to the middle dielectric layer 134 (described earlier in relation to FIGS. 1, 2, 4, 5, 6, 7, 8, 9, 10, 11, 13, and 15) and may include three or more sub-sections, which may be physically connected to each other. Furthermore, the third dielectric layer 2040 may optionally include only two sub-sections in order to produce a single cavity that surrounds the inner conductor 110 as described earlier in relation to FIGS. 4 and 5.

Figure 20F:
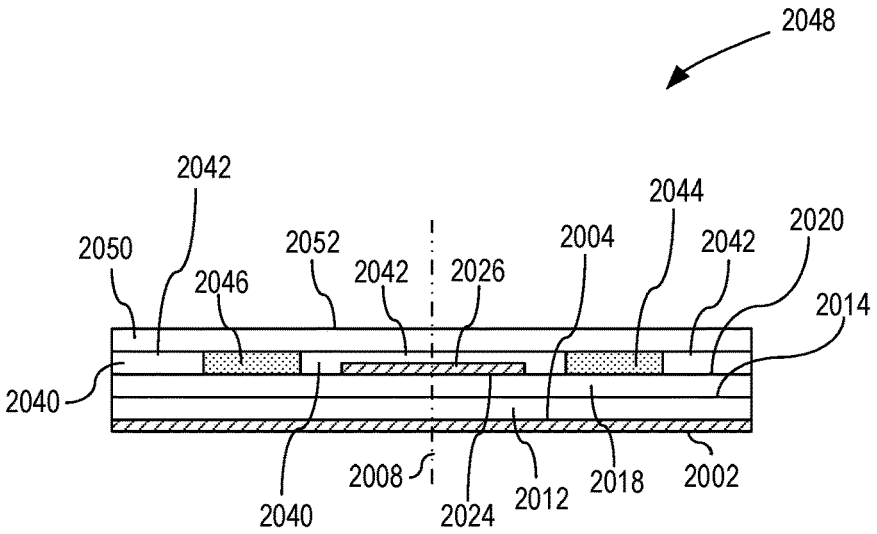
FIG. 20F is a cross-sectional view of a fifth combination of the fourth combination with a printed fourth dielectric layer in accordance with the present disclosure.

In FIG. 20F, a cross-sectional view of a fifth combination 2048 is shown in accordance with the present disclosure. The fifth combination 2048 is a combination of the fourth combination 2038 and a printed fourth dielectric layer 2050. Specifically, the printed fourth dielectric layer 2050 has a top surface 2052 and is printed on the top surface 2042 of the printed third dielectric layer 2040 covering the first cavity 2044 and second cavity 2046.

Figure 20G:
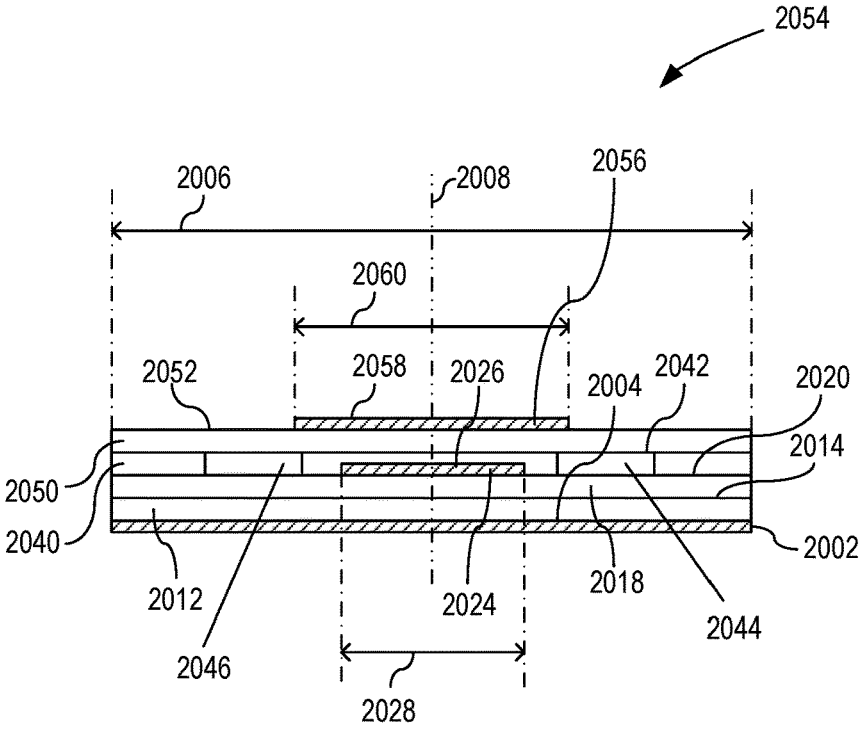
FIG. 20G is a cross-sectional view of a sixth combination of the fifth combination with a printed third conductive layer in accordance with the present disclosure.

In FIG. 20G, a cross-sectional view of the sixth combination 2054 of the fifth combination 2048 and a printed third conductive layer 2056 is shown in accordance with the present disclosure. Specifically, a printed third conductive layer 2056 with a top surface 2058 and a third width 2060 less than the first width 2006 is printed on a portion of the top surface 2052 of the printed fourth dielectric layer 2050 to produce the PAE 112 with antenna slot 114. It is appreciated by those skilled in the art that the sixth combination 2054 is an example of an implementation of the dielectric structure 104. In these examples, the conductive layers 2002, 2024, and 2056 may be printed with conductive ink.

Figure 21:
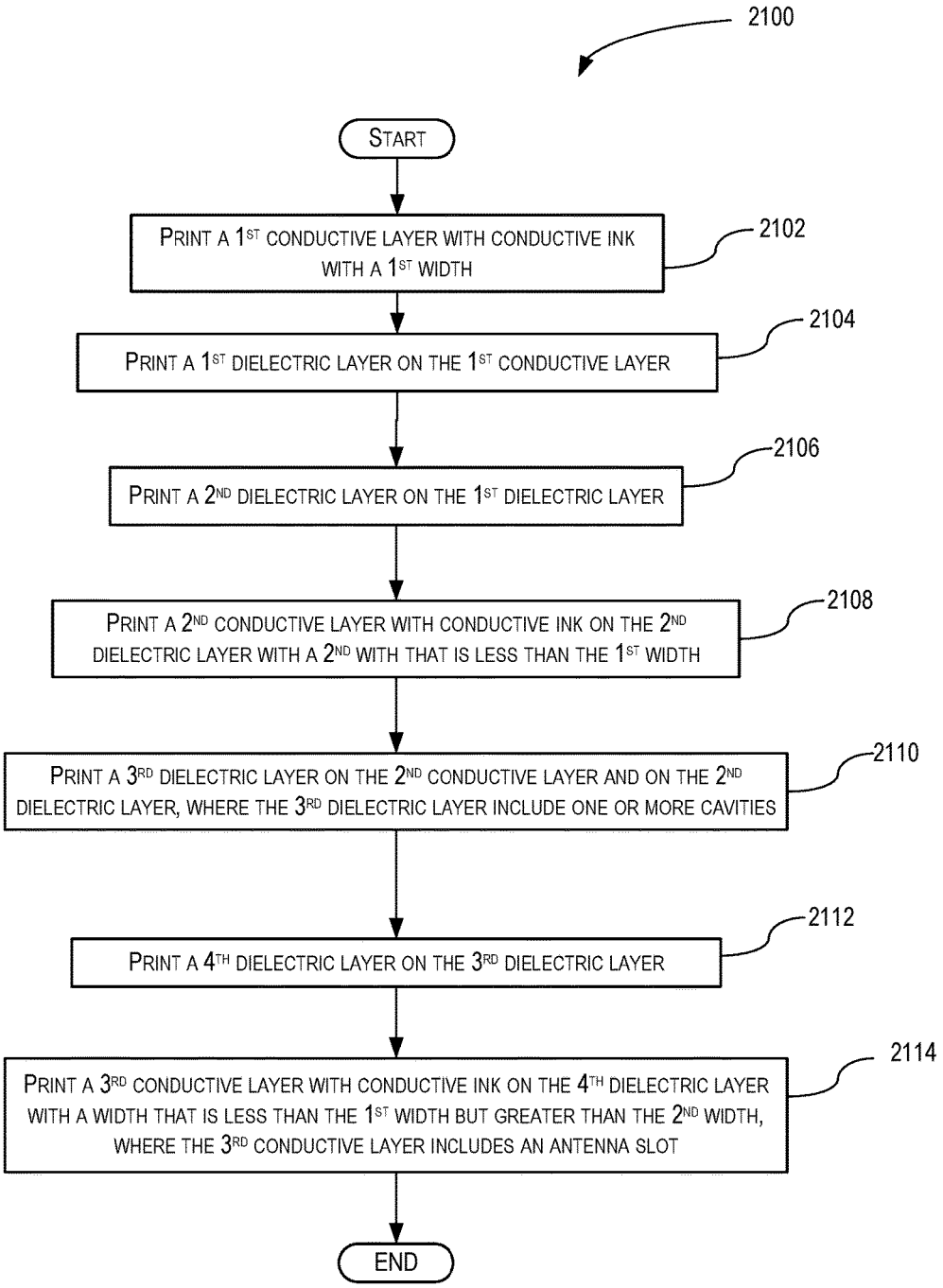
FIG. 21 is a flowchart of an example implementation of a method for fabricating the HGCA utilizing a three-dimensional ("3-D") additive printing process in accordance with the present disclosure.

In FIG. 21, a flowchart is shown of an example implementation of method 2100 for fabricating the HGCA (i.e., HGCA 100, 1200, or 1400) utilizing a three-dimensional ("3-D") additive printing process in accordance with the present disclosure. The method 2100 is for fabricating the HGCA (i.e., HGCA 100, 1200, or 1400) utilizing the additive 3-D printing process is shown in FIGS. 20A-20G.

The method 2100 starts by printing 2102 the first conductive layer 2002. The first conductive layer 2002 includes the top surface 2004 and the first width 2006 with the first center 2008. The method 2100 further includes printing 2104 the first dielectric layer 2012 with a top surface 2014 on the top surface 2004 of the first conductive layer 2002 and printing 2106 the second dielectric layer 2018 with a top surface 2020 on the top surface 2014 of the first dielectric layer 2012.

Moreover, the method 2100 includes printing 2108 the second conductive layer 2024 with a top surface 2026 and a second width 2028 less than the first width 2006 on the top surface 2020 of the second dielectric layer 2018 and printing 2110 the third dielectric layer 2040 with a top surface 2042 on the top surface 2026 of the second conductive layer 2024 and on the top surface 2020 on the second dielectric layer 2018. In this step, the third dielectric layer 2040 includes at least one cavity (i.e., cavity 2044 and cavity 2046) within the third dielectric layer 2040.

The method (e.g. process) 2100 then includes printing 2112 the fourth dielectric layer 2050 with a top surface 2052 on the top surface 2042 of the third dielectric layer 2040. Moreover, the method 2100 includes printing 2114 the third conductive layer 2056 with a top surface 2058 and a third width 2060 less than the first width 2006 on the top surface 2052 of the fourth dielectric layer 2050. The method 2100 then ends.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A high-gain conformal antenna comprising:

a dielectric structure comprising a plurality of dielectric layers, wherein a first dielectric layer of the plurality of dielectric layers includes a first surface of the dielectric structure;

a first conductor layer coupled to the dielectric structure opposite of the first surface;

an inner conductor between the first dielectric layer and the first conductor layer;

a cavity defined within the dielectric structure, wherein a portion of the cavity is defined within a second dielectric layer of the plurality of dielectric layers, the second dielectric layer between the first dielectric layer and the first conductor layer, and wherein a portion of the inner conductor is located within the cavity; and a patch antenna element on the first surface, the patch antenna element including a conductor and defining an antenna slot.

2. The high-gain conformal antenna of claim 1, wherein the patch antenna element is circular and has a radius.

3. The high-gain conformal antenna of claim 1, wherein the antenna slot is angled along the patch antenna element with respect to the inner conductor.

4. The high-gain conformal antenna of claim 1, wherein each dielectric layer, of the plurality of dielectric layers, is a dielectric laminate material.

5. The high-gain conformal antenna of claim 1, wherein the dielectric structure has a stack-up height, wherein the dielectric structure has a width, wherein a second portion of the inner conductor is located in a middle dielectric layer within the dielectric structure that is approximately at a center position that is equal to approximately half of the stack-up height, and wherein the inner conductor has an inner conductor center that is located within the dielectric structure that is approximately at a second center position that is equal to approximately half of the width of the dielectric structure.

6. The high-gain conformal antenna of claim 1, wherein the inner conductor is a stripline or microstrip conductor.

7. The high-gain conformal antenna of claim 1, further comprising:

a second cavity defined within the dielectric structure;

a second patch antenna element on the first surface; and a second antenna slot within the second patch antenna element.

8. The high gain conformal antenna of claim 1, further comprising:

a second inner conductor:

a power divider electrically connected to an input port and the inner conductor and second inner conductor:

a second cavity defined within the dielectric structure:

a second patch antenna element on the first surface; and a second antenna slot within the second patch antenna element.

9. The high-gain conformal antenna of claim 8, further comprising:

a third cavity defined within the dielectric structure:

a fourth cavity defined within the dielectric structure:

a third patch antenna element on the first surface with a third antenna slot: and a fourth patch antenna element on the first surface with a fourth antenna slot, wherein the inner conductor and second inner conductor are a microstrip or stripline conductor.

10. The high-gain conformal antenna of claim 1, wherein the cavity is filled with a gas.

11. The high-gain conformal antenna of claim 10, further comprising a second cavity defined within the dielectric structure, wherein the second cavity is defined within the second dielectric layer of the dielectric structure, wherein the inner conductor is defined within the second dielectric layer, wherein a portion of the inner conductor is disposed between the cavity from the second cavity, and wherein second cavity is filled with the gas.

12. The high-gain conformal antenna of claim 10, further comprising a plurality of cavities defined within the dielectric structure, wherein the cavity is a cavity of the plurality of cavities, wherein the plurality of cavities are defined within the second dielectric layer of the dielectric structure and wherein the plurality of cavities are filled with the gas.

13. The high-gain conformal antenna of claim 1, wherein a surface of the first conductor layer forms a plane, wherein a first axis runs through the patch antenna element and the cavity, and wherein the first axis is perpendicular with the plane.

14. A method for fabricating a high-gain conformal antenna utilizing a lamination process, the method comprising:

patterning a first conductive layer on a first surface of a first dielectric layer having a second surface and the first surface to produce a ground plane;

patterning a second conductive layer on a third surface of a second dielectric layer having the third surface and a fourth surface to produce an inner conductor;

laminating the fourth surface of the second dielectric layer to the second surface of the first dielectric layer;

patterning a third dielectric layer, wherein the third dielectric layer includes a fifth surface and a sixth surface;

patterning a third conductive layer on a seventh surface of a fourth dielectric layer having the seventh surface and an eighth surface to produce a patch antenna element with an antenna slot;

laminating the eighth surface of the fourth dielectric layer to the fifth surface of the third dielectric layer; and laminating the sixth surface of the third dielectric layer to the third surface of the second dielectric layer to produce a composite laminated structure.

15. The method of claim 14, wherein the first conductive layer, second conductive layer, and third conductive layer are conductive metals.

16. The method of claim 14, wherein the first conductive layer, the second conductive layer, or the third conductive layer is formed by a subtractive method.

17. A high-gain conformal antenna produced by the method of claim 16.

18. The high-gain conformal antenna of claim 17, wherein the antenna slot is angled along the patch antenna element with respect to the inner conductor.

19. A method for fabricating a high-gain conformal antenna utilizing a three-dimensional additive printing process, the method comprising:

printing a first conductive layer having a first surface and a first width, wherein the first width has a first center;

printing a first dielectric layer on the first surface of the first conductive layer, wherein the first dielectric layer has a second surface;

printing a second dielectric layer on the second surface of the first dielectric layer, wherein the second dielectric layer has a third surface;

printing a second conductive layer on the third surface of the second dielectric layer, wherein the second conductive layer has a fourth surface and a second width, and wherein the second width is less than the first width;

printing a third dielectric layer on the fourth surface of the second conductive layer and on the third surface on the second dielectric layer, wherein the third dielectric layer has a fifth surface and wherein the third dielectric layer defines at least one cavity;

printing a fourth dielectric layer on the fifth surface of the third dielectric layer, wherein the fourth dielectric layer has a sixth surface; and printing a third conductive layer on the sixth surface of the fourth dielectric layer to produce a patch antenna element, wherein the third conductive layer has a third width, wherein the third width is less than the first width, and wherein the third conductive layer includes an antenna slot within the third conductive layer that exposes the sixth surface of the fourth dielectric layer through the third conductive layer.

20. A high-gain conformal antenna produced by the method of claim 19.

21. The high-gain conformal antenna of claim 20, wherein the antenna slot is angled along the patch antenna element with respect to second conductive layer.

* * * * *